US008770156B2

(12) United States Patent
Theis et al.

(10) Patent No.: US 8,770,156 B2
(45) Date of Patent: Jul. 8, 2014

(54) COLD START SYSTEM FOR A MOTOR VEHICLE

(75) Inventors: M. Christine Theis, Denver, CO (US); Reuben Bergsten, Highlands Ranch, CO (US)

(73) Assignee: Honda Motor Co., Ltd., Tokyo (JP)

( * ) Notice: Subject to any disclaimer, the term of this patent is extended or adjusted under 35 U.S.C. 154(b) by 1311 days.

(21) Appl. No.: 12/353,207

(22) Filed: Jan. 13, 2009

(65) Prior Publication Data

US 2010/0176135 A1 Jul. 15, 2010

(51) Int. Cl.
*F02B 43/00* (2006.01)

(52) U.S. Cl.
USPC ..... 123/1 A; 123/3; 123/576

(58) Field of Classification Search
USPC ..... 123/1 A, 3, 520, 198 D, 495, 576, 2; 220/562; 440/88 R
See application file for complete search history.

(56) References Cited

U.S. PATENT DOCUMENTS

| | | | | |
|---|---|---|---|---|
| 4,188,969 | A * | 2/1980 | Lotton et al. | 137/264 |
| 4,911,116 | A * | 3/1990 | Prohaska et al. | 123/179.13 |
| 5,762,050 | A * | 6/1998 | Gonzalez | 123/516 |
| 6,119,637 | A * | 9/2000 | Matthews et al. | 123/3 |
| 6,242,119 | B1 * | 6/2001 | Komura et al. | 429/424 |
| 6,467,470 | B1 * | 10/2002 | Carlsson et al. | 123/576 |
| 6,584,997 | B1 * | 7/2003 | Blichmann et al. | 137/392 |
| 7,013,844 | B2 * | 3/2006 | Oda | 123/3 |
| 2006/0191727 | A1 | 8/2006 | Usami et al. | |
| 2007/0215069 | A1 * | 9/2007 | Leone | 123/1 A |

FOREIGN PATENT DOCUMENTS

| | | |
|---|---|---|
| JP | 04-342866 | 11/1992 |
| JP | 2007-309268 | 11/2007 |

* cited by examiner

*Primary Examiner* — Lindsay Low
*Assistant Examiner* — Omar Morales
(74) *Attorney, Agent, or Firm* — Plumsea Law Group, LLC

(57) ABSTRACT

A system and method for controlling a fuel system for a cold start of an engine is disclosed. An auxiliary fuel tank includes a separating device configured to separate a mixed fuel into a first fuel and a second fuel. A valve may be controlled to allow the flow of the first fuel to an engine of a motor vehicle to enable a cold start of the engine.

21 Claims, 16 Drawing Sheets

COLD START SYSTEM FOR A MOTOR VEHICLE

BACKGROUND OF THE INVENTION

1. Field of the Invention

The present invention relates to motor vehicles and in particular to a fuel system of a motor vehicle.

2. Description of Related Art

During low temperature conditions, fuel with a high percentage of gasoline may be required to start an engine. In motor vehicles using flexible fuel systems, this can be a problem if a mixed fuel used by the engine has a lower gasoline content than is required for cold-start situations. There is a need in the art for a design that solves this cold start problem.

SUMMARY OF THE INVENTION

A system and method for controlling a fuel system for a cold start of an engine is disclosed. Generally, these methods can be used in connection with an engine of a motor vehicle. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to: cars, trucks, vans, minivans, SUV's, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy, for example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In one aspect, the invention provides an auxiliary fuel tank for a motor vehicle, comprising: an intake line configured to deliver a mixed fuel to the auxiliary fuel tank; a separating device configured to separate the mixed fuel into a first fuel and a second fuel; a first compartment configured to store the first fuel and a second compartment configured to store the second fuel; a sensor system configured to detect fuel level information of the first fuel in the first compartment; a valve configured to control the inflow of the mixed fuel from the intake line; and where the valve is controlled according to the fuel level information.

In another aspect, the invention provides a cold start system for a motor vehicle, comprising: a primary fuel tank configured to store a mixed fuel and an auxiliary fuel tank configured to receive a portion of the mixed fuel from the primary fuel tank; the auxiliary fuel tank including a separating device for separating the mixed fuel into a first fuel and a second fuel; the auxiliary fuel tank including a first compartment configured to store the first fuel and a second compartment configured to store the second fuel; the primary fuel tank and the auxiliary fuel tank being further connected to a valve that controls flow to the engine; the valve including a first position wherein the first compartment is in fluid communication with the engine and wherein the primary fuel tank is blocked from fluid communication with the engine; the valve including a second position wherein the primary fuel tank is in fluid communication with the engine and wherein the first compartment is blocked from fluid communication with the engine; and where the valve is disposed in the first position whenever the engine temperature is below a predetermined temperature and wherein the valve is disposed in a second position whenever the engine temperature is above the predetermined temperature.

In another aspect, the invention provides a method of operating a cold start system for a motor vehicle, comprising the steps of: receiving information related to a current engine temperature; comparing the current engine temperature with a predetermined engine temperature; placing an auxiliary fuel tank in fluid communication with an engine and blocking fluid communication between the primary fuel tank and the engine whenever the current engine temperature is less than the predetermined engine temperature; and placing the primary fuel tank in fluid communication with the engine and blocking fluid communication between the auxiliary fuel tank and the engine whenever the current engine temperature is above the predetermined engine temperature.

In another aspect, the invention provides a cold start system for a motor vehicle, comprising: a primary fuel tank configured to store a mixed fuel and an auxiliary fuel tank disposed within the primary fuel tank, the auxiliary fuel tank configured to receive a portion of the mixed fuel from the primary fuel tank; a separating device for separating the mixed fuel into a first fuel and a second fuel, the separating device disposed between the auxiliary fuel tank and the primary fuel tank; the separating device allowing the second fuel to pass from the auxiliary fuel tank to the primary fuel tank and the separating device preventing the mixed fuel from passing from the primary fuel tank to the auxiliary fuel tank; and where the primary fuel tank is in fluid communication with the engine when the engine temperature is above a predetermined engine temperature and wherein the auxiliary fuel tank is in fluid communication with the engine when the engine temperature is below a predetermined engine temperature.

Other systems, methods, features and advantages of the invention will be, or will become, apparent to one of ordinary skill in the art upon examination of the following figures and detailed description. It is intended that all such additional systems, methods, features and advantages included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF ONE EMBODIMENT

Figure 1:
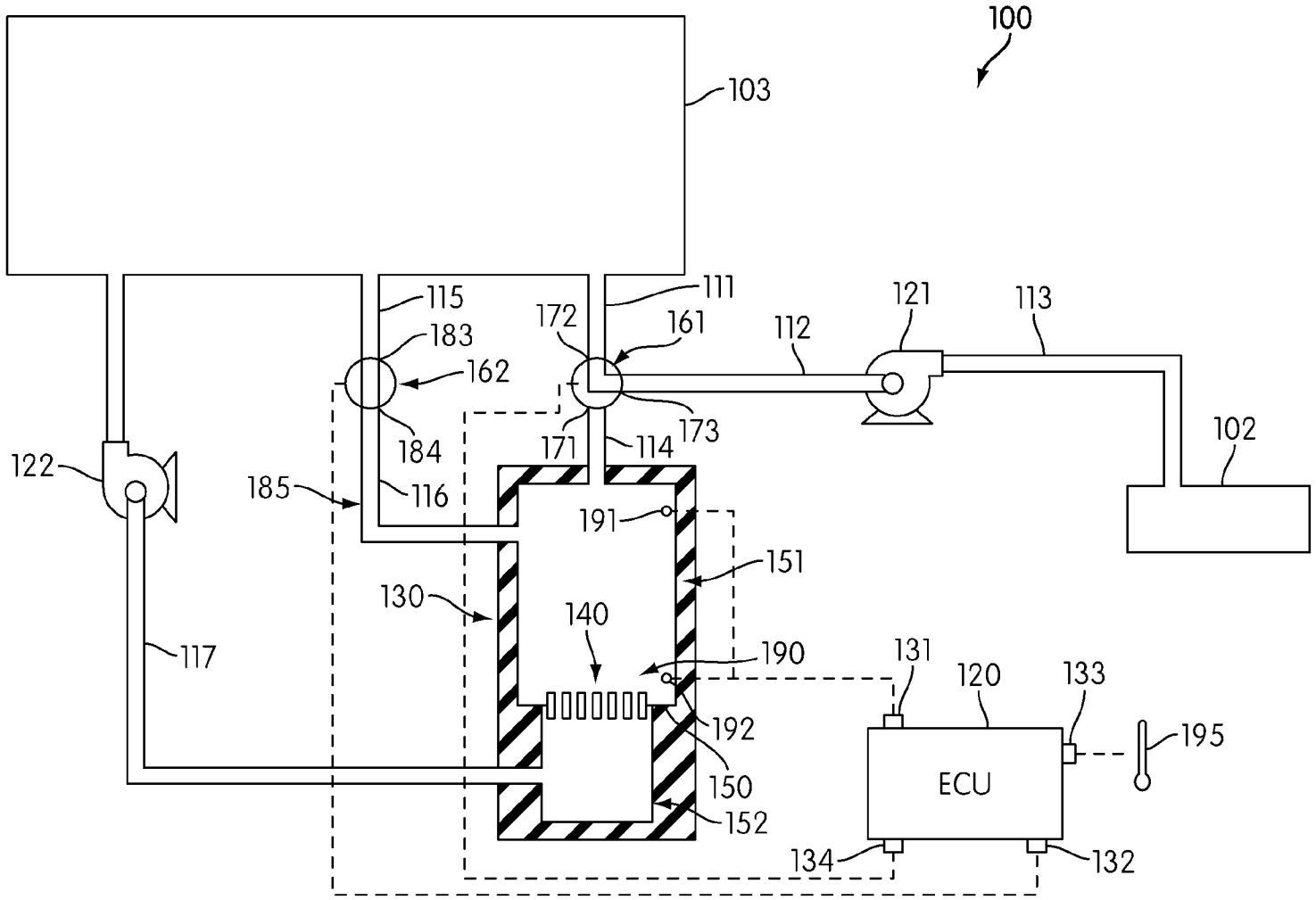
FIG. 1 is a schematic view of an exemplary embodiment of a portion of a fuel system.

FIG. 1 is a schematic view of an exemplary embodiment of a portion of fuel system 100. In some embodiments, fuel system 100 may be associated with an engine, which is not shown in FIG. 1 for purposes of clarity. Generally, fuel system 100 may be associated with any type of engine capable of producing torque. Furthermore, fuel system 100 may be associated with any type of motor vehicle, including, but not limited to: cars, trucks, vans, minivans, SUV's, motorcycles, scooters, boats, personal watercraft, and aircraft.

Generally, fuel system 100 may be configured to store and deliver fuel to an engine. In some embodiments, fuel system 100 may deliver fuel to individual fuel injectors of an engine. In an exemplary embodiment, fuel system 100 may deliver fuel to a fuel rail 102 of an engine. However, in other embodiments, fuel system 100 may be associated with another portion of an engine that delivers fuel to the engine.

Fuel system 100 includes primary fuel tank 103. Primary fuel tank 103 may be configured to store fuel for an engine. In some embodiments, primary fuel tank 103 may store a mixed fuel. The term "mixed fuel" as used throughout this detailed description and in the claims, applies to a mixture of two or more fuels. For example, in some cases, a mixed fuel may be a mixture of gasoline and ethanol. Generally, mixtures of gasoline and ethanol can include different proportions of ethanol including, but not limited to: E20, E75 and E80. In other cases, primary fuel tank 103 may store other types of mixed fuel including, but not limited to: methanol and gasoline mixtures, p-series fuels as well as other mixed fuels.

In some embodiments, fuel system 100 can be configured with one or more fuel lines to deliver fuel to fuel rail 102. In one embodiment, fuel system 100 includes first fuel line 111, second fuel line 112 and third fuel line 113. With this arrangement, fuel system 100 may facilitate the flow of mixed fuel from primary fuel tank 103 to fuel rail 102 of an engine.

In some embodiments, fuel may be delivered through fuel lines to an engine with the force of gravity. In other embodiments, one or more fuel pumps may facilitate the flow of fuel to an engine. In some cases, a fuel pump may pump fuel to an engine at a high pressure. In other cases, a fuel pump may pump fuel to an engine at a low pressure.

In different embodiments, a fuel pump may be disposed within different locations of fuel system 100 to pump fuel to fuel rail 102. For example, in some cases, a fuel pump may be disposed within primary fuel tank 103. In other cases, a fuel pump may be associated with fuel lines of fuel system 100. In one embodiment, second fuel line 112 and third fuel line 113 may be associated with first fuel pump 121. With this arrangement, first fuel pump 121 may facilitate the flow of fuel from second fuel line 112 to third fuel line 113.

Fuel system 100 may also include auxiliary fuel tank 130. Auxiliary fuel tank 130 may be configured to store fuel for an engine. Generally, auxiliary fuel tank 130 may be configured with various sizes and shapes to store fuel for an engine. In some embodiments, auxiliary fuel tank 130 may have a greater capacity than primary fuel tank 103. In other embodiments, auxiliary fuel tank 130 may have a substantially similar capacity as primary fuel tank 103. In one embodiment, auxiliary fuel tank 130 may be configured with less capacity than primary fuel tank 103.

In some cases, mixed fuels may not be sufficient to start a cold engine. Instead, a cold engine may require a fuel comprising a substantial proportion of gasoline to start. Once the cold engine is started, however, a mixed fuel may be sufficient to run the engine.

A fuel system that stores a mixed fuel can include provisions to start a cold engine with a fuel comprising a substantial proportion of gasoline. In some cases, a fuel system can include a separating device to separate a mixed fuel into a first fuel and a second fuel. The first fuel may be substantially gasoline. The second fuel may be a fuel such as ethanol that is mixed with gasoline to produce a mixed fuel. With this arrangement, the first fuel comprising a substantial proportion of gasoline can be delivered to an engine to allow a cold start of the engine.

In different embodiments, a fuel system can include different types of separating devices that separate a mixed fuel into a first fuel and a second fuel. In some embodiments, a separating device may comprise an ethanol permeable membrane that separates ethanol from a mixed fuel of ethanol and gasoline. In other words, the ethanol permeable membrane can separate the mixed fuel by allowing only ethanol or ethanol and water to penetrate the ethanol permeable membrane. Examples of ethanol permeable membranes include, but are not limited to: porous zeolite films, porous silica films and porous organic films. An example of one ethanol permeable membrane can be found in U.S. Patent Application Publication Number 20060191727, the entirety of which is hereby incorporated by reference.

In one embodiment, fuel system 100 includes separating device 140. Separating device 140 is configured to separate a mixed fuel into a first fuel and a second fuel. In particular, separating device 140 may be an ethanol permeable membrane. In addition, separating device 140 permits one-way fuel exchange. In other words, ethanol or ethanol and water can penetrate separating device 140 in only one direction. With this arrangement, fuel system 100 can separate a mixed fuel into a first fuel that is substantially gasoline and a second fuel that is substantially ethanol.

Generally, separating device 140 may be disposed in various locations in fuel system 100. In some embodiments, separating device 140 may be disposed within primary fuel tank 103. In other embodiments, separating device 140 may be disposed within auxiliary fuel tank 130.

In some embodiments, separating device 140 may be associated with two compartments of auxiliary fuel tank 130. In one embodiment, separating device 140 may be disposed at boundary 150 of auxiliary fuel tank 130 that separates auxiliary fuel tank 130 into two compartments. In particular, boundary 150 may separate first compartment 151 of auxiliary fuel tank 130 from second compartment 152 of auxiliary fuel tank 130. First compartment 151 may be configured to store a first fuel. Similarly, second compartment 152 may be configured to store a second fuel. With this arrangement, separating device 140 can separate a mixed fuel into a first fuel that may be stored in first compartment 151 and a second fuel that may be stored in second compartment 152.

In different embodiments, the arrangement of compartments within auxiliary fuel tank 130 will vary. In an exemplary embodiment, the compartments of auxiliary fuel tank 130 are arranged vertically with first compartment 151 disposed above second compartment 152. This allows gravity to help a second fuel penetrate separating device 140 so that the second fuel is stored in second compartment 152. In other embodiments, however, compartments of auxiliary fuel tank 130 may be arranged in a horizontal manner or in any other manner. In embodiments where the arrangement of compartments prevents gravity from assisting with the separation of a mixed fuel, a vacuum or pump can be used to facilitate the separation of mixed fuels by separating device 140.

In order to deliver a first fuel to an engine to allow a cold start, first compartment 151 of auxiliary fuel tank 130 may be in fluid communication with an engine. This can be accomplished by connecting first compartment 151 to an engine through one or more fuel lines. In one embodiment, first compartment 151 is in fluid communication with fuel rail 102 through fourth fuel line 114, second fuel line 112 and third fuel line 113. With this arrangement, the first fuel from first compartment 151 may be delivered to fuel rail 102 to allow a cold start of an engine.

In some embodiments, a valve may be configured to control a flow of fuel to an engine. In some cases, a valve may be disposed in a first position to provide fluid communication between a first compartment of an auxiliary fuel tank and an engine. In the first position, the valve may be configured to prevent fluid communication between a primary fuel tank and the engine. In addition, the valve may be disposed in a second position to provide fluid communication between the primary fuel tank and the engine. Furthermore, the second position of the valve can prevent fluid communication between the first compartment and the engine. With this configuration, the valve may allow a flow of mixed fuel from the primary fuel tank or a flow of first fuel from the first compartment of the auxiliary fuel tank.

In one embodiment, fuel system 100 includes first valve 161. First valve 161 may be connected to auxiliary fuel tank 130 and primary fuel tank 103. In particular, first valve 161 may be in fluid communication with first compartment 151 of auxiliary fuel tank 130 by fourth fuel line 114. In some cases, first intake port 171 of first valve 161 may be in fluid communication with first compartment 151 via fourth fuel line 114. In a similar manner, first valve 161 may be in fluid communication with primary fuel tank 103 by first fuel line 111. In particular, second intake port 172 of first valve 161 may be in fluid communication with primary fuel tank 103 via first fuel line 111.

In addition, first valve 161 may also be in fluid communication with fuel rail 102 of an engine. In some cases, first outtake port 173 of first valve 161 may be in fluid communication with fuel rail 102 of an engine via second fuel line 112 and third fuel line 113. With this arrangement, first valve 161 may control flow of fuel to an engine.

In some embodiments, first valve 161 may be disposed in a first position to allow fluid communication between a first fuel in first compartment 151 and fuel rail 102 of an engine. In particular, first valve 161 provides fluid communication between first intake port 171 and first outtake port 173 to allow fluid communication between a first fuel in first compartment 151 and an engine in the first position. Furthermore, in this first position, first valve 161 prevents fluid communication between second intake port 172 and first outtake port 173. With this configuration, a first fuel disposed in first compartment 151 may be delivered to fuel rail 102 to allow a cold start of an engine when first valve 161 is in a first position.

In a similar manner, first valve 161 can be disposed in a second position to provide fluid communication between a mixed fuel in primary fuel tank 103 and fuel rail 102. In other words, the second position of first valve 161 can provide fluid communication between second intake port 172 and first outtake port 173 to allow fluid communication between a mixed fuel in primary fuel tank 103 and an engine in the second position. In addition, the second position of first valve 161 prevents fluid communication between first intake port 171 and first outtake port 173. Using this arrangement, a mixed fuel disposed in primary fuel tank 103 can be delivered to fuel rail 102 when first valve 161 is in a second position.

In different embodiments, first valve 161 may comprise different types of valves. Examples of valves include, but are not limited to: solenoid valves, other types of hydraulic valves, other types of pneumatic valves, gate valves, ball valves as well as other types of valves. In one embodiment, first valve 161 is a solenoid valve.

Generally, an auxiliary fuel tank may be filled with fuel in any manner known in the art. In some embodiments, an auxiliary fuel tank may be filled directly from a source external to a fuel system. In other embodiments, an auxiliary fuel tank may receive a portion of mixed fuel from a primary fuel tank. In some cases, an auxiliary fuel tank may receive a portion of mixed fuel from a primary fuel tank through an intake line.

In some embodiments, fuel system 100 can include intake line 185 to deliver a portion of mixed fuel from primary fuel tank 103 to auxiliary fuel tank 130. In one embodiment, intake line 185 may comprise fifth fuel line 115 and sixth fuel line 116. With this arrangement, intake line 185 can deliver a portion of mixed fuel from primary fuel tank 103 to auxiliary fuel tank 130.

A fuel system can include provisions to control the flow of fuel from an intake line into an auxiliary fuel tank. In some embodiments, a valve may be configured to control the inflow of mixed fuel from the intake line. By controlling the valve, mixed fuel may be delivered to fill an auxiliary fuel tank.

Fuel system 100 includes second valve 162 that may be associated with intake line 185. In one embodiment, second valve 162 may be disposed between fifth fuel line 115 and sixth fuel line 116 to control the inflow of mixed fuel from primary fuel tank 103 to auxiliary fuel tank 130. In particular, fifth fuel line 115 may be connected to third intake port 183 of second valve 162. Likewise, sixth fuel line 116 may be connected to second outtake port 184 of second valve 162. With this arrangement, second valve 162 can control an inflow of mixed fuel from intake line 185 to auxiliary fuel tank 130.

Generally, second valve 162 can be any type of valve including, but not limited to: solenoid valves, other types of hydraulic valves, other types of pneumatic valves, gate valves, ball valves as well as other types of valves. In one embodiment, second valve 162 is a solenoid valve.

In an alternative embodiment, an intake line configured to deliver a mixed fuel to an auxiliary fuel tank may be associated with a fuel pump. The fuel pump can increase the efficiency of the separation of a mixed fuel within the auxiliary fuel tank. In some cases, a fuel pump can increase the pressure of a mixed fuel entering an auxiliary fuel tank so that the mixed fuel has a pressure greater than atmospheric pressure. This can allow more efficient separation of the mixed fuel by a separating device. In other cases, a fuel pump can increase the temperature of a mixed fuel entering an auxiliary fuel tank to allow more efficient separation of the mixed fuel by a separating device.

In some embodiments, a second fuel may be returned to a primary fuel tank from an auxiliary fuel tank by a return line. In other embodiments, a second fuel can be diffused into the primary fuel tank via gravity. In one embodiment, fuel system 100 includes return line 117. Return line 117 may be configured to provide fluid communication between second compartment 152 of auxiliary fuel tank 130 and primary fuel tank 103. With this arrangement, a second fuel from second compartment 152 may be returned to primary fuel tank 103 using return line 117.

In some embodiments, a second fuel may be delivered through return line 117 to primary fuel tank 103 by the force of gravity. In other embodiments, a pump may be associated with return line 117 to facilitate the delivery of a second fuel to primary fuel tank 103. In one embodiment, return line 117 may be associated with second fuel pump 122. Using this configuration, second fuel pump 122 may assist in the return of a second fuel from second compartment 152 to primary fuel tank 103.

A fuel system may include provisions to control an inflow of mixed fuel from an intake line to an auxiliary fuel tank according to fuel level information. In some embodiments, fuel level information may be determined by information received from a sensor system. In some cases, an auxiliary fuel tank may be associated with at least one fuel level sensor configured to detect fuel level information of a first fuel in a first compartment.

Auxiliary fuel tank 130 includes sensor system 190. In some embodiments, sensor system 190 includes one sensor that detects fuel level information of a first fuel within first compartment 151. In some cases, sensor system 190 includes one low level fuel sensor. In other embodiments, sensor system 190 includes more than one sensor to detect the fuel level of a first fuel within first compartment 151. In some cases, sensor system 190 can include a high level fuel sensor. In other cases, sensor system 190 can include a low level fuel sensor. In an exemplary embodiment, sensor system 190 can include both a high level fuel sensor and a low level fuel sensor.

In one embodiment, sensor system 190 includes high level fuel sensor 191 and low level fuel sensor 192. Generally, high level fuel sensor 191 and low level fuel sensor 192 can be any type of sensor known in the art to detect fuel level. In particular, high level fuel sensor 191 can detect if first compartment 151 is substantially full. Likewise, low level fuel sensor 192 can detect if first compartment 151 is substantially empty. With this configuration, sensor system 190 can detect fuel level information of a first fuel in first compartment 151.

In some embodiments, fuel system 100 may be associated with a computer or similar device configured to communicate, and in some cases control, the various components associated with fuel system 100. In one embodiment, fuel system 100 can be associated with electronic control unit 120, hereby referred to as ECU 120.

ECU 120 may include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 120 are optional. Some embodiments may include a given port or provision, while others may exclude it. The following description discloses many of the possible ports and provisions that can be used, however, it should be kept in mind that not every port or provision must be used or included in a given embodiment.

ECU 120 can include provisions for transferring information and/or power with sensor system 190. In some cases, ECU 120 can include first port 131 configured to transfer information and/or power to sensor system 190. With this arrangement, ECU 120 can receive fuel level information of a first fuel from sensor system 190.

ECU 120 can also include provisions for transferring information and/or power with second valve 162. In some cases, ECU 120 can include second port 132 configured to transfer information and/or power to second valve 162. With this arrangement, ECU 120 can control the operation of second valve 162. In particular, ECU 120 can control second valve 162 to prevent or allow fluid communication between auxiliary fuel tank 130 and primary fuel tank 103.

In some embodiments, ECU 120 can include provisions for manually controlling second valve 162. In other embodiments, ECU 120 can include provisions for automatically controlling second valve 162. In still other embodiments, ECU 120 can simultaneously include both manual and automatic provisions for controlling second valve 162.

ECU 120 can also include provisions for transferring information and/or power with components of an engine. In some embodiments, ECU 120 can be configured to transfer information regarding a current temperature of an engine. In one embodiment, ECU 120 can include provisions to transfer information and/or power to engine temperature sensor 195. Engine temperature sensor 195 may be configured in various manners known in the art to detect a current temperature of an engine. In some cases, ECU 120 can include third port 133 configured to transfer information and/or power to engine temperature sensor 195. With this arrangement, ECU 120 can receive information regarding the current temperature of an engine from engine temperature sensor 195.

ECU 120 may be configured with provisions to control a first valve and deliver a first fuel to an engine in the event of a cold start of an engine. In order to determine if an engine is cold, ECU 120 can store a predetermined temperature that may be compared to a current engine temperature to determine if the engine is cold. In some embodiments, the predetermined temperature can be determined experimentally. In other embodiments, the predetermined temperature can be determined theoretically. In some cases, the predetermined temperature can vary according to other environmental conditions including, but not limited to: pressure and humidity. In other cases, the predetermined temperature can be a fixed value.

In embodiments where first valve 161 provides fluid communication between first compartment 151 and fuel rail 102, ECU 120 may be configured with provisions to transfer information/and or power to first valve 161. In particular, ECU 120 can include fourth port 134 configured to transfer information and/or power to first valve 161. With this configuration, ECU 120 can control the operation of first valve 161 so that first valve 161 may be disposed in a first position to provide fluid communication with fuel rail 102 and first compartment 151 during a cold start of an engine. In addition, ECU 120 can control first valve 161 so that first valve 161 operates in a second position to deliver a mixed fuel from primary fuel tank 103 to fuel rail 102 during normal operation of an engine.

Figure 2:
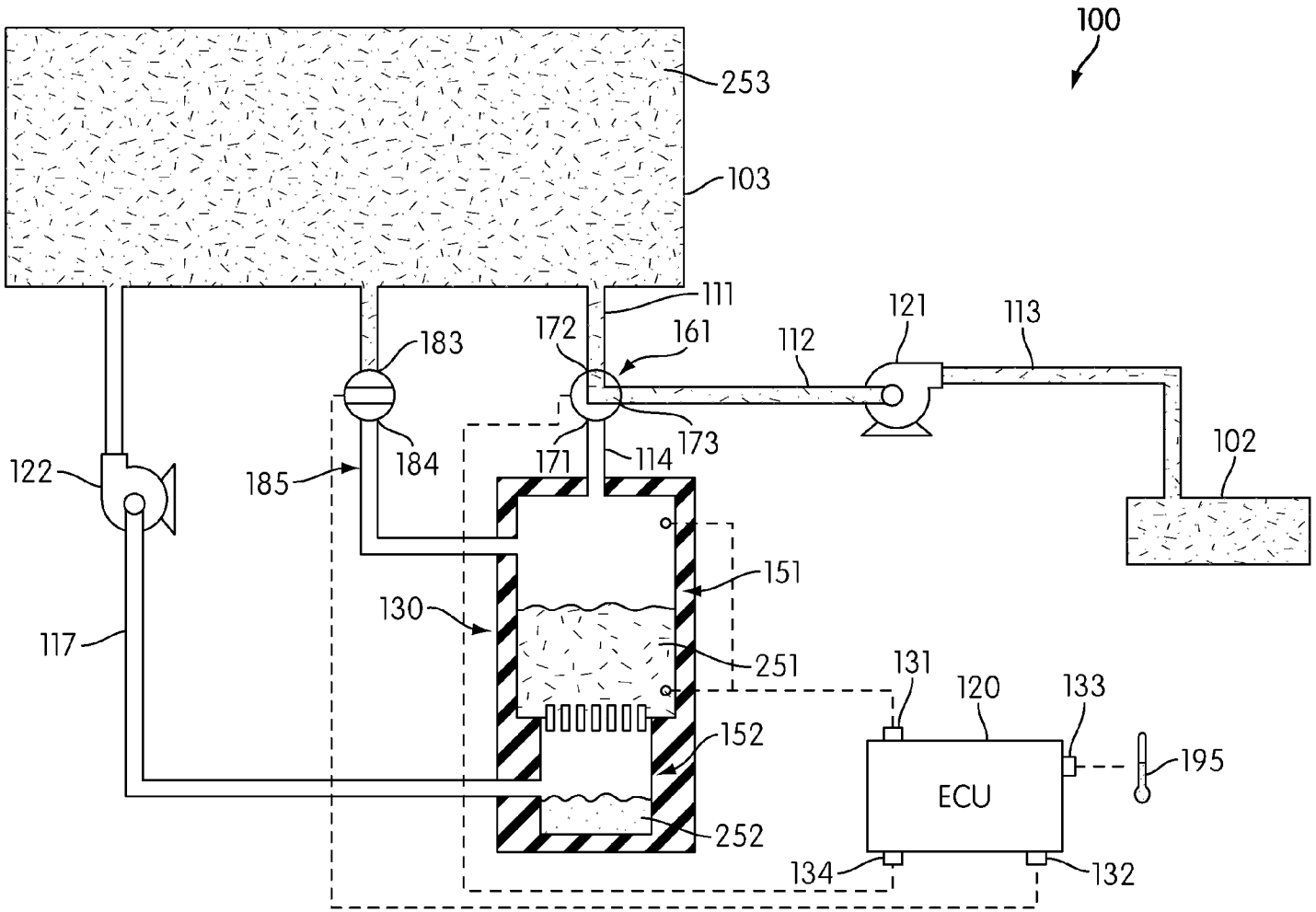
FIG. 2 is a schematic view of an exemplary embodiment of a fuel system delivering mixed fuel from a primary fuel tank to an engine.

FIG. 2 is a schematic view of an embodiment fuel system 100 delivering fuel from primary fuel tank 103 to an engine. In this exemplary embodiment, primary fuel tank 103 stores mixed fuel 253. Mixed fuel 253 is a mixture of gasoline and ethanol. In addition, first compartment 151 of auxiliary fuel tank 130 stores first fuel 251. First fuel 251 comprises a substantial proportion of gasoline. Also, second compartment 152 of auxiliary fuel tank 130 stores second fuel 252. Second fuel 252 comprises a substantial proportion of ethanol.

As previously discussed, third port 133 of ECU 120 receives information related to the current engine temperature from engine temperature sensor 195. By comparing the current engine temperature with a predetermined temperature, ECU 120 can determine that the current engine temperature is above the predetermined temperature. In other words, ECU 120 determines the engine is not cold.

Since a cold start of the engine is not required, ECU 120 operates first valve 161 in a second position. In the second position, second intake port 172 and first outtake port 173 are in fluid communication. This allows fluid communication between a mixed fuel in primary fuel tank 103 and fuel rail 102 of an engine. Furthermore, in the second position, first valve 161 prevents fluid communication between a first fuel in first compartment 151 of auxiliary fuel tank 130 and fuel rail 102. Using this arrangement, mixed fuel 253 may be delivered from primary fuel tank 103 to fuel rail 102 via first fuel line 111, first valve 161, second fuel line 112, first fuel pump 121 and third fuel line 113.

In this exemplary embodiment, ECU 120 operates second valve 162 in a closed position. In the closed position, third intake port 183 is not in fluid communication with second outtake port 184. With this configuration, intake line 185 is prevented from delivering mixed fuel 253 from primary fuel tank 103 to auxiliary fuel tank 130. However, in other embodiments, ECU 120 may operate second valve 162 in an open position allowing intake line 185 to deliver mixed fuel 253 to auxiliary fuel tank 130.

Figure 3:
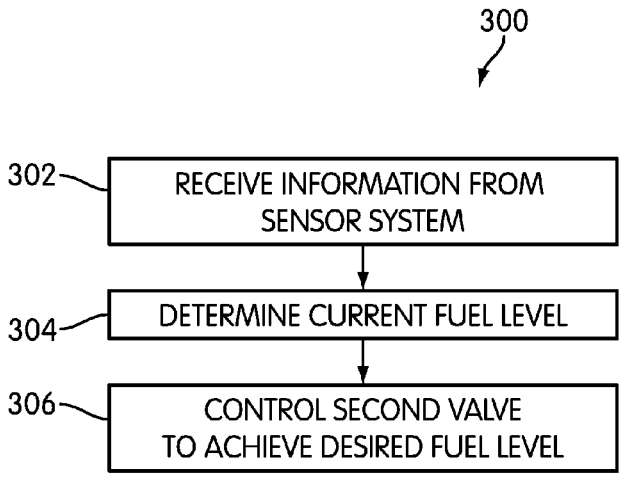
FIG. 3 is an exemplary embodiment of a process for controlling a second valve to fill an auxiliary fuel tank with mixed fuel from a primary fuel tank.

FIG. 3 is an exemplary embodiment of process 300 for operating a second valve to fill an auxiliary fuel tank. In an exemplary embodiment, the following steps are performed by ECU 120. However, in some embodiments, these steps may be performed by additional systems or devices associated with fuel system 100.

During first step 302, ECU 120 receives information from a sensor system regarding the fuel level of an auxiliary fuel tank. With information regarding fuel level of the auxiliary fuel tank, ECU 120 proceeds to second step 304 and determines a current fuel level of the auxiliary fuel tank. After determining the current fuel level of the auxiliary fuel tank, ECU 120 operates a second valve to achieve a desired fuel level of a first fuel within the auxiliary fuel tank at third step 306. In other words, during third step 306, ECU 120 may open the second valve to fill an auxiliary fuel tank when the current fuel level is low.

Figure 4:
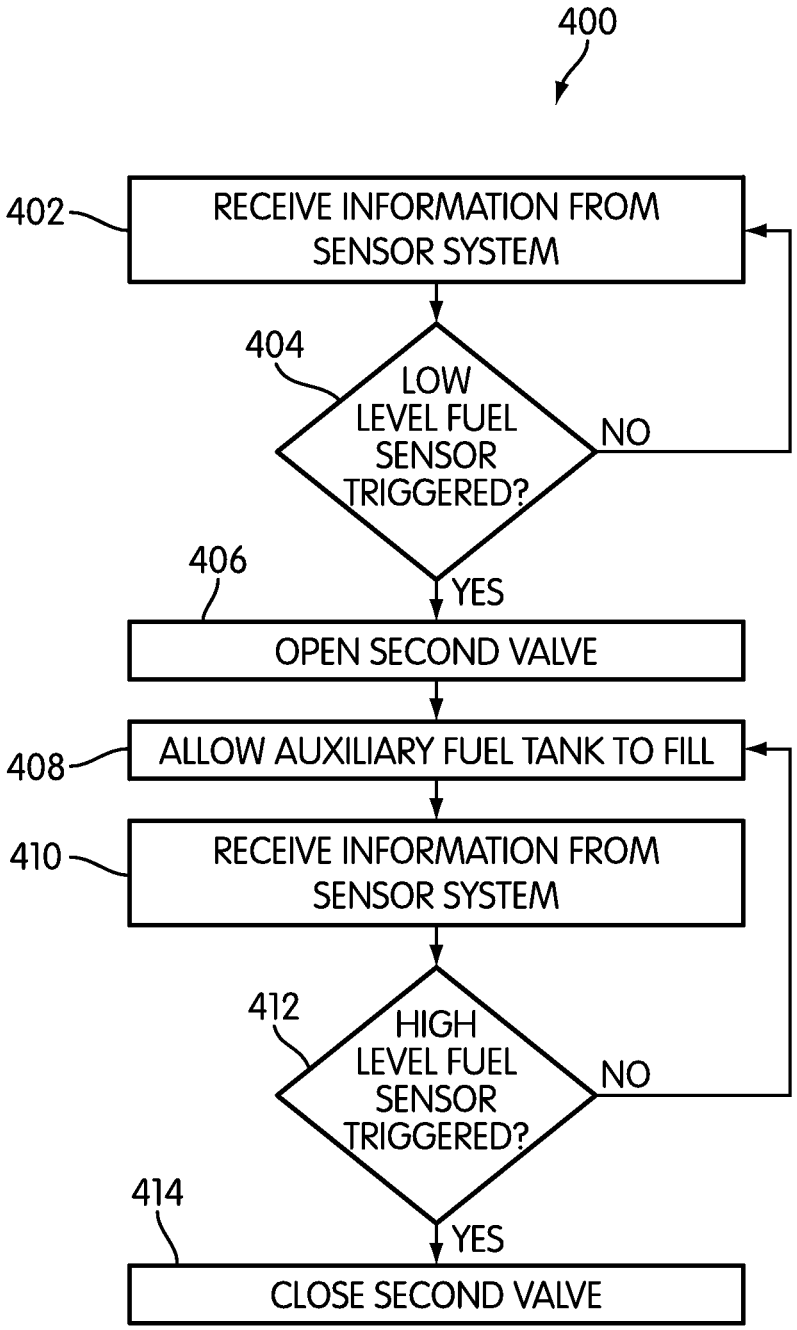
FIG. 4 is an exemplary embodiment of a process for controlling a second valve to fill an auxiliary fuel tank with mixed fuel from a primary fuel tank.

FIG. 4 is an exemplary embodiment of process 400 for operating a second valve to fill an auxiliary fuel tank according to fuel level information received by a high level fuel sensor and a low level fuel sensor. In some embodiments, the following steps are performed by ECU 120, however, in other embodiments, the following steps may be performed by additional systems or devices associated with fuel system 100. In some cases, the high level fuel sensor and low level fuel sensor may be high level fuel sensor 191 and low level fuel sensor 192, respectively, of sensor system 190, as illustrated in FIG. 1.

During first step 402, ECU 120 receives information from a sensor system with a high level fuel sensor and a low level fuel sensor. Following first step 402, ECU proceeds to second step 404. During second step 404, ECU 120 determines if the low level fuel sensor is triggered. In some cases, the low level fuel sensor may be triggered when the fuel level drops beneath the low level fuel sensor. If ECU 120 determines that the low level fuel sensor has not been triggered, ECU 120 returns to first step 402.

However, if ECU 120 determines that the low level fuel sensor has been triggered during second step 404, ECU 120 proceeds to third step 406. During third step 406, ECU 120 opens a second valve configured to control the inflow of mixed fuel from an intake line. Following third step 406, ECU 120 proceeds to fourth step 408 and allows the auxiliary fuel tank to fill. Then ECU 120 proceeds to fifth step 410. During fifth step 410, ECU 120 receives information from the sensor system. After fifth step 410, ECU 120 proceeds to sixth step 412.

During sixth step 412, ECU determines if the high level fuel sensor is triggered. In some cases, the high level fuel sensor can be triggered when the fuel level rises above the high level fuel sensor. If ECU 120 determines that the high level fuel sensor has not been triggered, ECU 120 returns to fourth step 408 and allows the auxiliary fuel tank to fill. However, if ECU 120 determines that the high level fuel sensor has been triggered, ECU 120 proceeds to seventh step 414 and closes the second valve. By closing the second valve, ECU 120 prevents an inflow of mixed fuel from the primary fuel tank to the auxiliary fuel tank.

Figure 5:
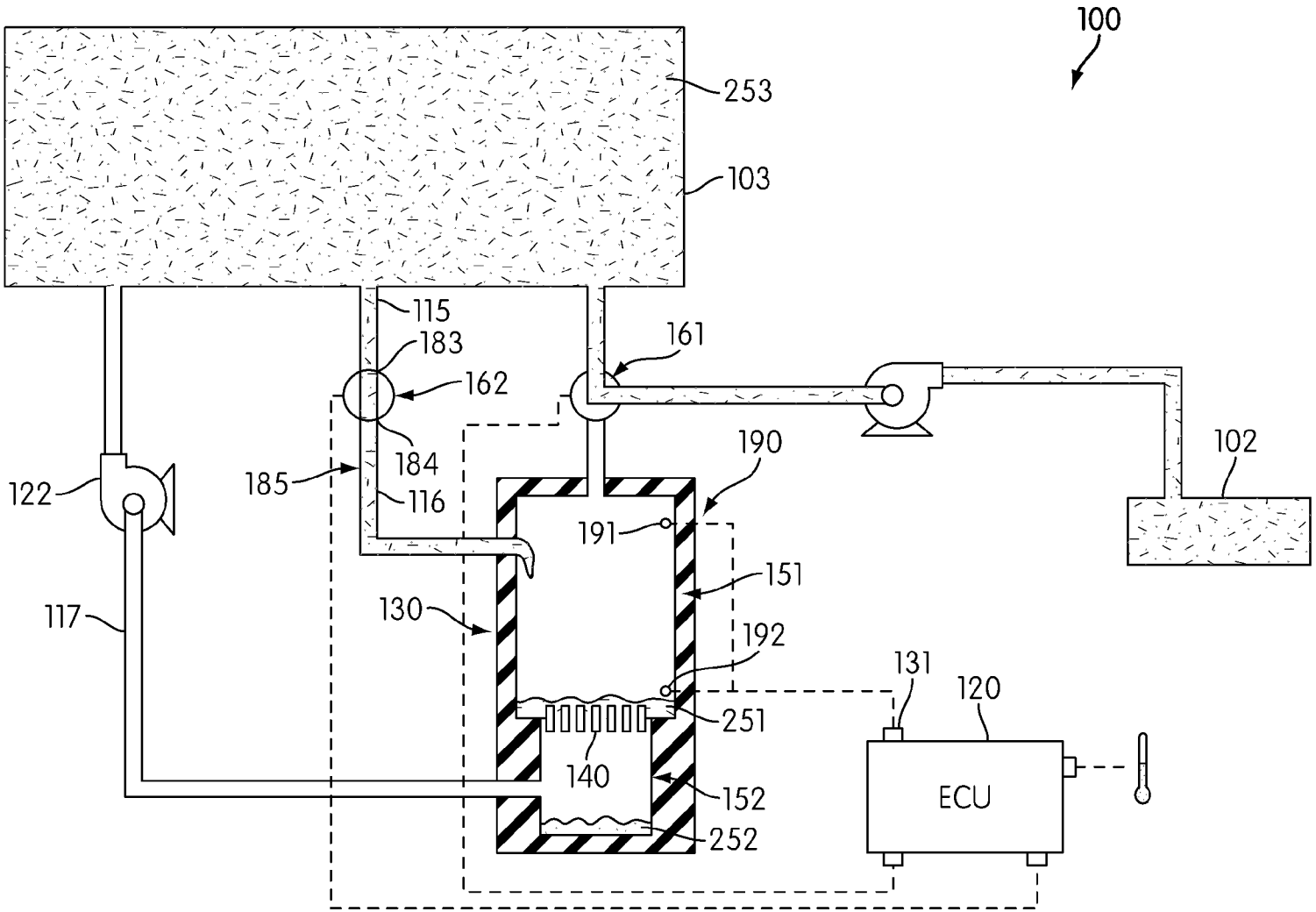
FIG. 5 is a schematic view of an exemplary embodiment of a primary fuel tank filling an auxiliary fuel tank with mixed fuel.

FIG. 5 is a schematic view of an exemplary embodiment of fuel system 100 with auxiliary fuel tank 130 substantially empty of fuel. In particular, first compartment 151 is substantially empty of first fuel 251. Since the fuel level of first fuel 251 is below low level fuel sensor 192, low fuel level sensor 192 is triggered.

With low level fuel sensor 192 triggered, ECU 120 receives information from sensor system 190 that low level fuel sensor 192 has been triggered via first port 131. In response to the triggering of low level fuel sensor 192, ECU 120 opens second valve 162 to allow the inflow of mixed fuel 253 through intake line 185. In particular, ECU 120 operates second valve 162 so that third intake port 183 and second outtake port 184 allow mixed fuel to flow through second valve 162. With this arrangement, mixed fuel 253 may be delivered from primary fuel tank 103 through fifth fuel line 115 and sixth fuel line 116 to first compartment 151 of auxiliary fuel tank 130.

Figure 6:
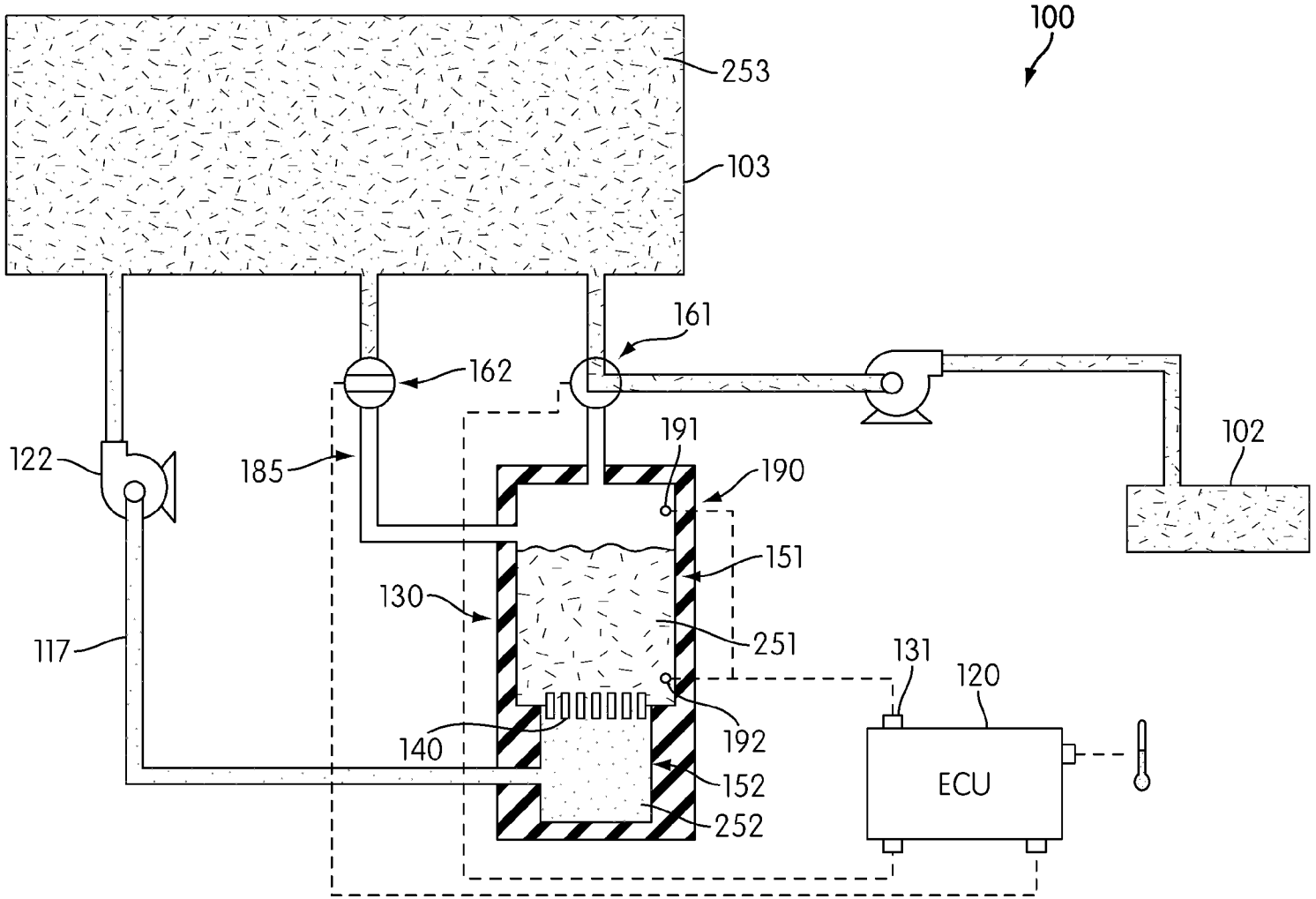
FIG. 6 is a schematic view of an exemplary embodiment of a second fuel from an auxiliary fuel tank returning to a primary fuel tank.

As mixed fuel 253 enters first compartment 151, mixed fuel 253 may be disposed adjacent to separating device 140 by the force of gravity. This arrangement allows second fuel 252 to penetrate separating device 140 and cross into second compartment 152, as illustrated in FIG. 6. Since separating device 140 permits only one-way fuel exchange, second fuel 252 may not cross back into first compartment 151. Using this arrangement, second fuel 252 may penetrate and remain in second compartment 252. Furthermore, the penetration of separating device 140 by second fuel 252 results in higher concentrations of first fuel 251 within first compartment 151.

When the fuel level within first compartment 151 rises above high level fuel sensor 191, high level fuel sensor 191 is triggered. ECU 120 receives information from sensor system 190 that high level fuel sensor 191 has been triggered via first port 131. In response to the triggering of high level fuel sensor 191, ECU 120 closes second valve 162. The closing of second valve 162 prevents the flow of mixed fuel through third intake port 183 and second outtake port 184. Using this arrangement, the inflow of mixed fuel 253 from primary fuel tank 103 is prevented from entering auxiliary fuel tank 130.

After any remaining second fuel 252 within first compartment 151 penetrates separating device 140, first compartment 151 may be filled with first fuel 251. Likewise, second compartment 152 may be filled with second fuel 252. In some cases, second fuel 252 may be returned to primary fuel tank 103 via return line 117.

Figure 7:
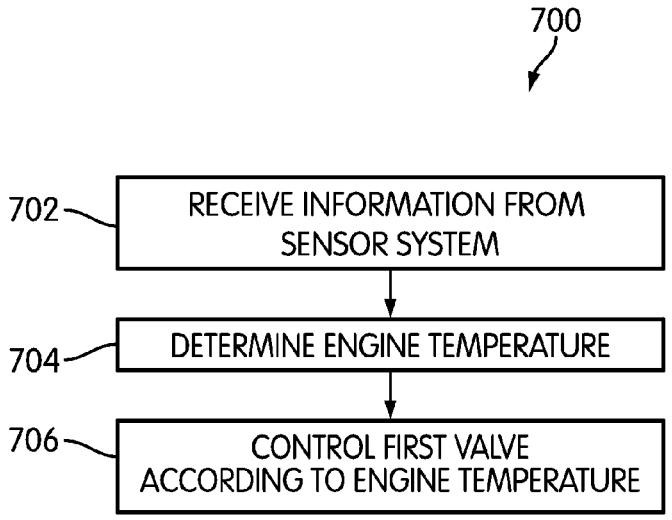
FIG. 7 is an exemplary embodiment of a process for controlling a first valve according to engine temperature.

FIG. 7 is an exemplary embodiment of process 700 for controlling a valve that delivers fuel to an engine according to engine temperature. In an exemplary embodiment, the following steps are performed by ECU 120. However, in some embodiments, these steps may be performed by additional systems or devices associated with fuel system 100.

During first step 702, ECU 120 receives information from sensors including, but not limited to: information from sensor system 190 and engine temperature sensor 195. Following first step 702, ECU 120 proceeds to second step 704. During second step 704, ECU 120 determines engine temperature from information received from engine temperature sensor 195. After determining engine temperature, ECU 120 controls a valve that delivers fuel to an engine according to engine temperature in third step 706.

Figure 8:
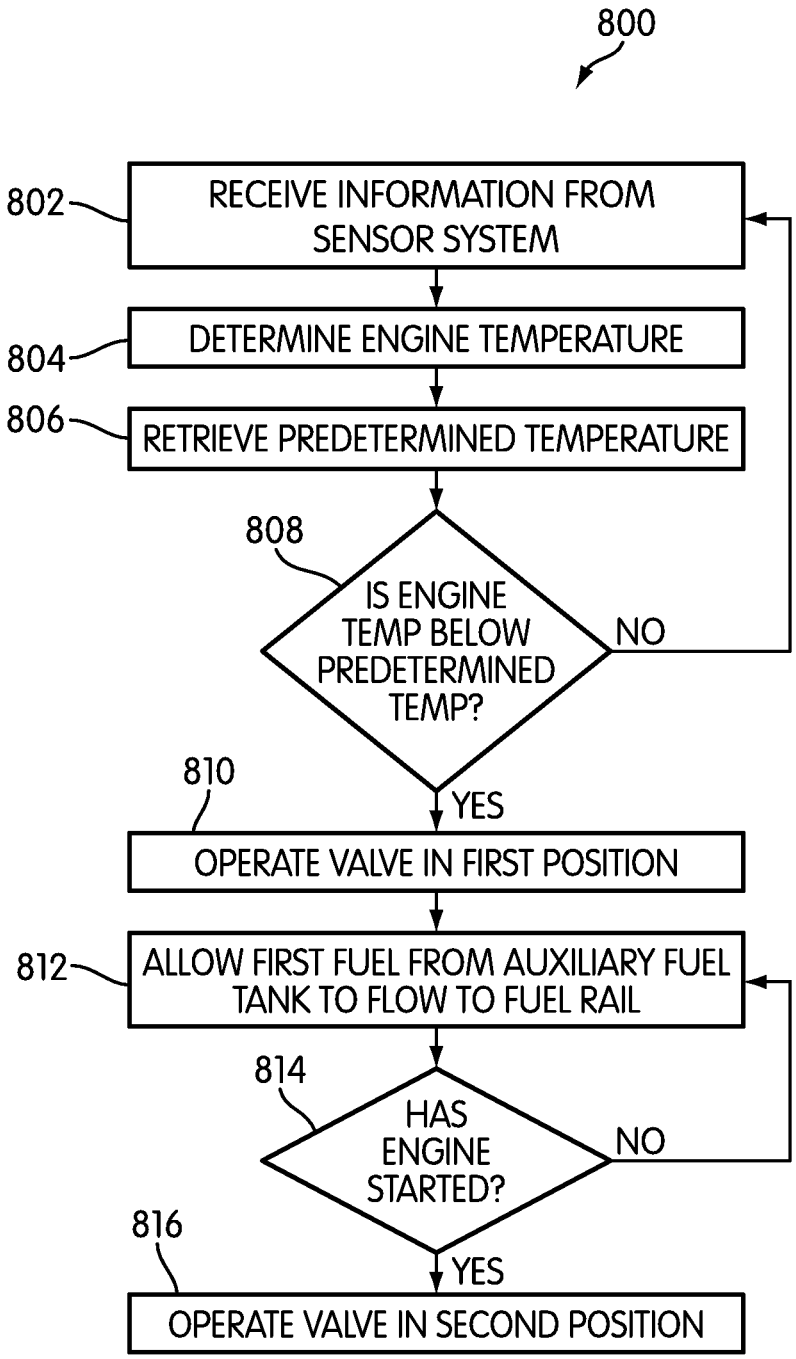
FIG. 8 is an exemplary embodiment of a process for controlling a first valve according to engine temperature.

FIG. 8 is an exemplary embodiment of process 800 for controlling a valve that delivers fuel to an engine according to engine temperature. In some embodiments, the following steps are performed by ECU 120, however, in other embodiments, the following steps may be performed by additional systems or devices associated with a fuel system.

During first step 802, ECU 120 receives information from sensors including, but not limited to: information from sensor system 190 and engine temperature sensor 195. Following first step 802, ECU 120 proceeds to second step 804 and determines engine temperature from information received from engine temperature sensor 195. After determining engine temperature, ECU 120 proceeds to third step 806.

During third step 806, ECU 120 retrieves a predetermined temperature. As previously discussed, the predetermined temperature may vary according to environmental conditions, including, but not limited to: pressure and humidity or may be a fixed value. In some embodiments, ECU 120 may retrieve a predetermined temperature from memory. In other embodiments, ECU 120 may determine a predetermined temperature. For example, in some cases, ECU 120 may determine a predetermined temperature as a function of a set of parameters. In other cases, ECU 120 may use a lookup table to determine a predetermined temperature.

Following third step 806, ECU 120 proceeds to fourth step 808. During fourth step 808, ECU 120 determines if the engine temperature is below the predetermined temperature. If the engine temperature is not below the predetermined temperature, ECU 120 returns to first step 802. In other words, if the engine temperature is above or equal to the predetermined temperature, ECU 120 returns to first step 802.

However, if the engine temperature is below the predetermined temperature, ECU 120 proceeds to fifth step 810. During fifth step 810, ECU 120 operates a valve in a first position. The first position of the valve may be associated with a cold start of an engine. Following fifth step 810, ECU 120 proceeds to sixth step 812. During sixth step 812, ECU 120 allows a first fuel from an auxiliary fuel tank to flow to a fuel rail.

Following sixth step 812, ECU 120 proceeds to seventh step 814. During seventh step 814, ECU 120 detects whether the engine has started. If the engine has not started, ECU 120 returns to sixth step 812. If the engine has started, ECU 120 proceeds to eighth step 816. During eighth step 816, ECU 120 operates the valve in a second position. The second position may be associated with operating an engine without a cold start. In particular, the second position of the valve may allow fluid communication between a primary fuel tank and a fuel rail of an engine and prevent fluid communication between an auxiliary fuel tank and a fuel rail.

Figure 9:
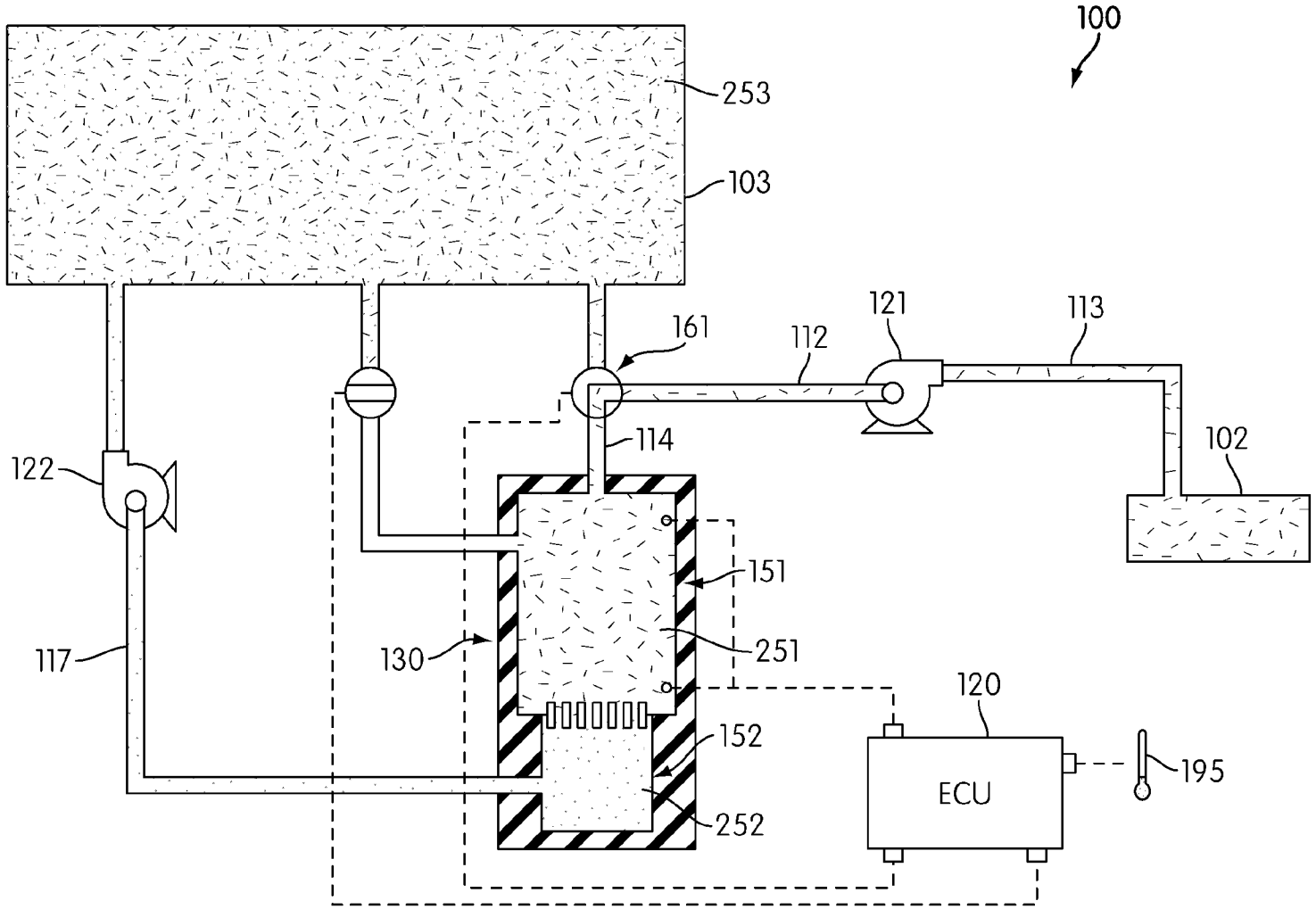
FIG. 9 is a schematic view of an exemplary embodiment of a valve in a first position associated with a cold start of an engine.
Figure 10:
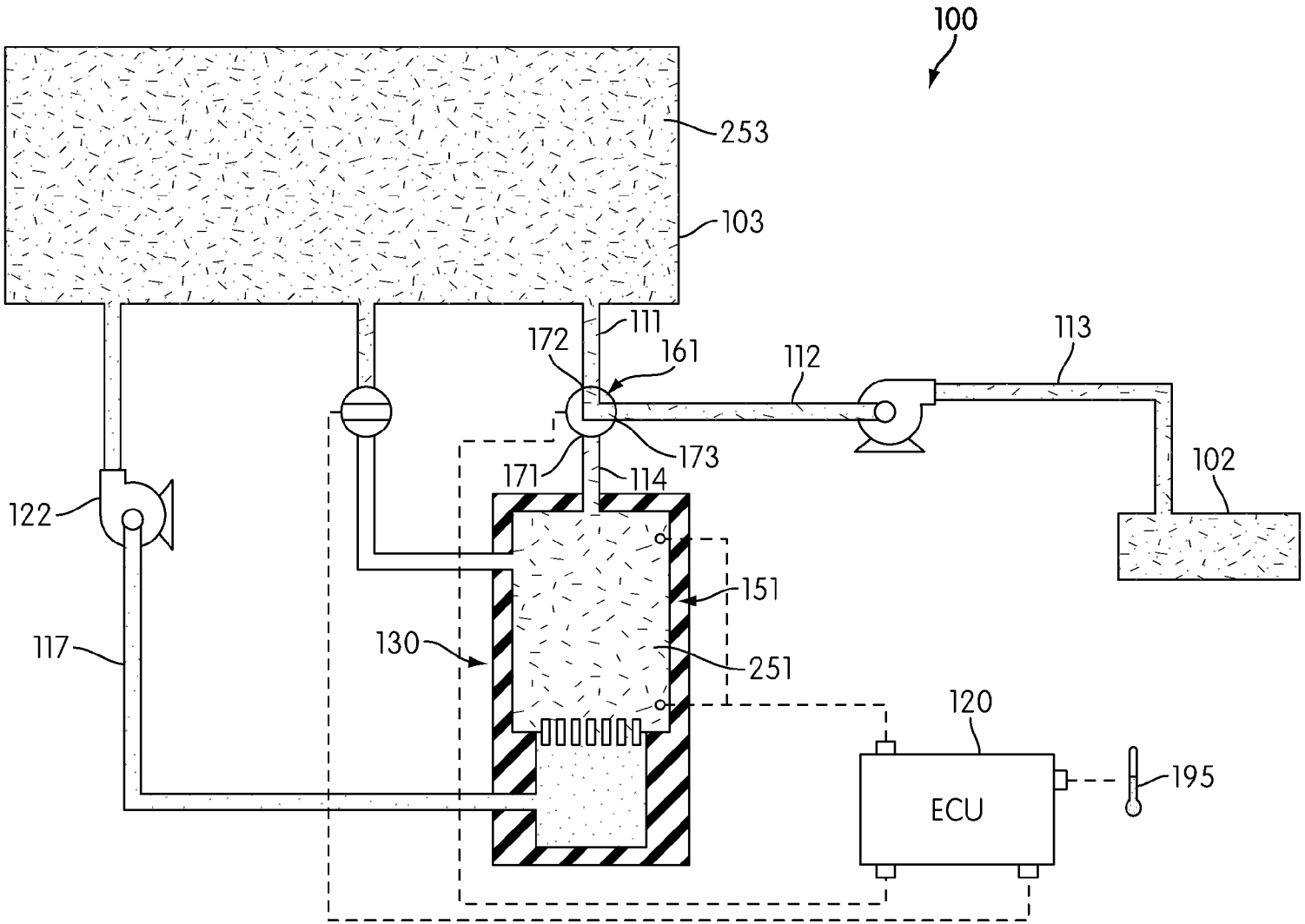
FIG. 10 is a schematic view of an exemplary embodiment of a valve in a second position associated with normal operation of an engine.

FIGS. 9 and 10 illustrate schematic views of an exemplary embodiment of fuel system 100 delivering fuel to an engine during a cold start of an engine and without a cold start of an engine, respectively. Similar to previous embodiments, in this exemplary embodiment, primary fuel tank 103 stores mixed fuel 253. In addition, first compartment 151 of auxiliary fuel tank 130 stores first fuel 251. Likewise, second compartment 152 of auxiliary fuel tank 130 stores second fuel 252. In some embodiments, second fuel 252 may also be present in return line 117 as second fuel 252 is delivered from second compartment 152 to primary fuel tank 103.

Referring to FIG. 9, ECU 120 receives information related to engine temperature from engine temperature sensor 195. After determining that the current engine temperature is below a predetermined temperature, ECU 120 operates first valve 161 in a first position associated with a cold start of an engine. In the first position, first fuel 251 from first compartment 151 is in fluid communication with fuel rail 102 of an engine. Furthermore, mixed fuel 253 from primary fuel tank 103 is prevented from fluid communication with fuel rail 102 of an engine when first valve 161 is in a first position. With this arrangement, first fuel 251 may be delivered to an engine to enable a cold start of an engine.

With information received from engine temperature sensor 190, ECU 120 may determine that the engine temperature has risen and is equal to or above the predetermined temperature. In response to an engine temperature above a predetermined temperature, ECU 120 operates first valve 161 in a second position associated with operating an engine without a cold start, as illustrated in FIG. 10. In the second position, mixed fuel 253 from primary fuel tank 103 is in fluid communication with fuel rail 102 of an engine. Also, first fuel 251 from first compartment 151 is prevented from fluid communication with fuel rail 102 of an engine when first valve 161 is in a second position. This arrangement allows mixed fuel 253 to be delivered to fuel rail 102 when the engine does not require a cold start.

In different embodiments, an auxiliary fuel tank of a fuel system may be disposed in various locations of the fuel system. As previously discussed, an auxiliary fuel tank may be disposed outside of a primary fuel tank. In other embodiments, however, an auxiliary fuel tank may be disposed within a primary fuel tank. Furthermore, in some cases, an auxiliary fuel tank disposed within a primary fuel tank may comprise a single compartment to store a first fuel such as gasoline.

Figure 11:
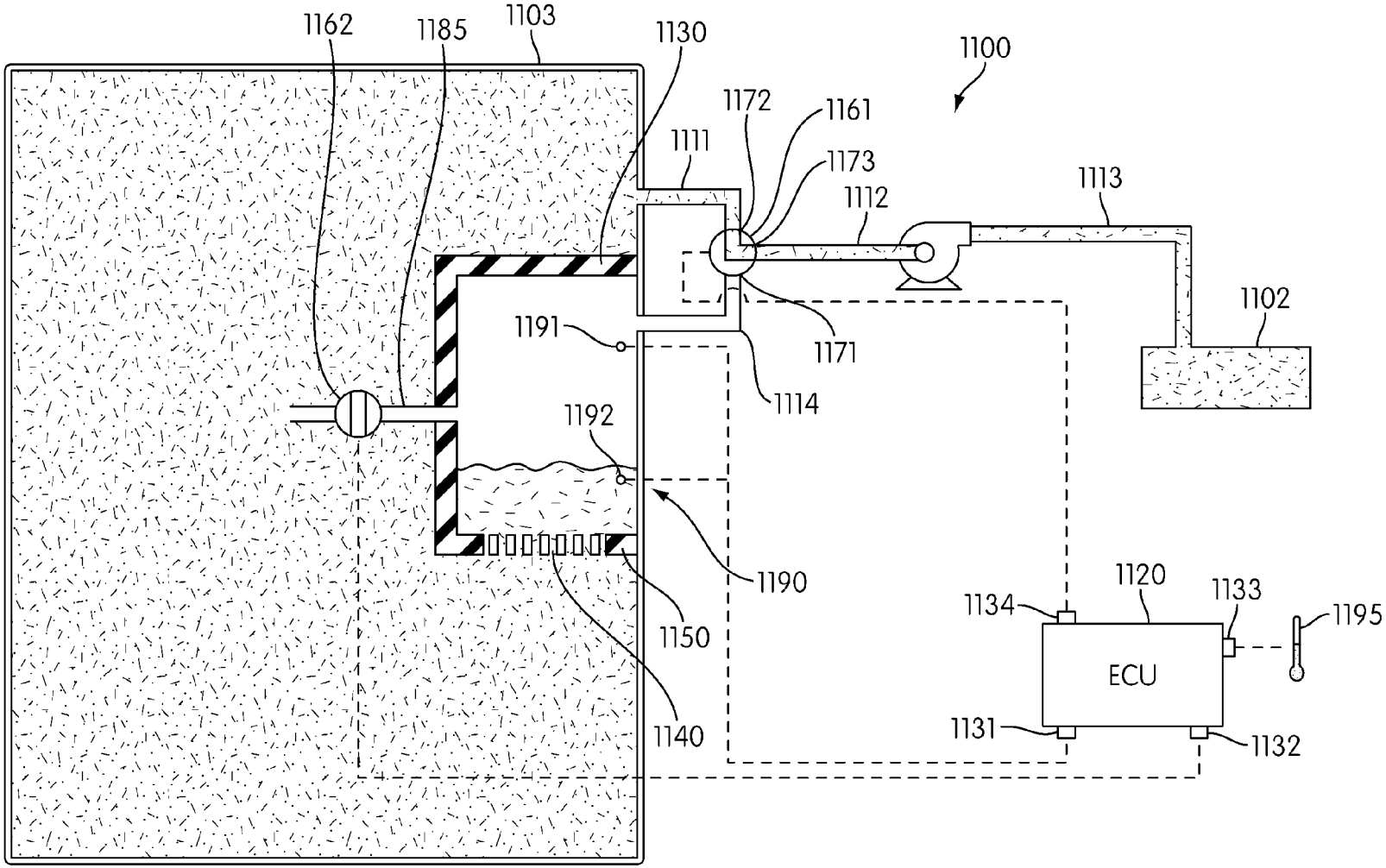
FIG. 11 is a schematic view of an exemplary embodiment of a portion of a fuel system.

FIG. 11 is a schematic view of an exemplary embodiment of a portion of fuel system 1100. Fuel system 1100 includes primary fuel tank 1103 that may store a mixed fuel for an engine. In some cases, a mixed fuel from primary fuel tank 1103 may be delivered to fuel rail 1102 of an engine via first fuel line 1111, second fuel line 1112 and third fuel line 1113.

Fuel system 1100 also includes auxiliary fuel tank 1130. In an exemplary embodiment, auxiliary fuel tank 1130 may be disposed within primary fuel tank 1103. In other words, auxiliary fuel tank 1130 may be disposed inside the interior of primary fuel tank 1103. In one embodiment, auxiliary fuel tank 1130 may be fixedly attached to a sidewall of primary fuel tank 1103. However, in other embodiments, auxiliary fuel tank 1130 may be disposed within primary fuel tank 1103 in a different manner.

In some embodiments, auxiliary fuel tank 1130 may comprise a single compartment. In other embodiments, auxiliary fuel tank 1130 can include two or more distinct compartments. In some cases, auxiliary fuel tank 1130 may be configured to store a first fuel. In one embodiment, the first fuel may be substantially gasoline.

Fuel system 1100 may also include separating device 1140. As previously discussed, separating device 1140 may be configured to separate a mixed fuel into a first fuel that is substantially gasoline and a second fuel that is substantially ethanol. In some cases, separating device 1140 may permit ethanol to penetrate separating device 1140 in one direction.

In embodiments where auxiliary fuel tank 1130 is disposed within primary fuel tank 1103, separating device 1140 may be disposed at boundary 1150 between auxiliary fuel tank 1130 and primary fuel tank 1103. In some cases, separating device 1140 may be disposed between auxiliary fuel tank 1130 and primary fuel tank 1103 so that the force of gravity assists in the separation of a mixed fuel in a first fuel and a second fuel. In other words, auxiliary fuel tank 1130 may be disposed above separating device 1140 and a portion of primary fuel tank 1103 may be disposed below separating device 1140. This arrangement can facilitate the separation of a mixed fuel into a first fuel and a second fuel by separating device 1140.

In other embodiments, separating device 1140 may be disposed between auxiliary fuel tank 1130 and primary fuel tank 1103 in a different manner. Furthermore, in embodiments where gravity may not be used to separate a mixed fuel into a first fuel and a second fuel, an auxiliary fuel tank can be pressurized in a manner that facilitates separation. For example, in an alternative embodiment, the pressure of auxiliary fuel tank 1130 can be automatically controlled to help push a second fuel through separating device 1140. Likewise, in still another embodiment, the pressure of a primary fuel tank can be automatically controlled to help pull a second fuel through separating device 1140.

As a second fuel disposed within auxiliary fuel tank 1130 penetrates separating device 1140, the second fuel may flow directly into primary fuel tank 1103. Since separating device 1140 permits only one-way fuel exchange, the second fuel may not cross separating device 1140 back into auxiliary fuel tank 1130. With this arrangement, the first fuel may be retained in auxiliary fuel tank 1130.

It will be understood that in still another embodiment, separating device 1140 may be configured to allow a first fuel, such as gasoline, to permeate from primary fuel tank 1103 to auxiliary fuel tank 1130. In such an embodiment, auxiliary fuel tank 1130 and/or primary fuel tank 1103 can be pressurized to allow a first fuel to fill into auxiliary fuel tank 1130.

In order to deliver a first fuel to an engine to allow a cold start, auxiliary fuel tank 1130 may be in fluid communication with fuel rail 1102 of an engine. In one embodiment, auxiliary fuel tank 1130 may be in fluid communication with fuel rail 1102 through fourth fuel line 1114, second fuel line 1112 and third fuel line 1113. Using this configuration, the first fuel from auxiliary fuel tank 1130 may be delivered to fuel rail 1102 to allow a cold start of an engine.

In some embodiments, fuel system 1100 may include first valve 1161 to control a flow of fuel to an engine. In some cases, first intake port 1171 of first valve 1161 may be in fluid communication with auxiliary fuel tank 1130 via fourth fuel line 1114. Similarly, second intake port 1172 of first valve 1161 may be in fluid communication with primary fuel tank 1103 by first fuel line 1111. In addition, outtake port 1173 of first valve 1161 may be in fluid communication with fuel rail 1102 of an engine via second fuel line 1112 and third fuel line 1113. With this arrangement, first valve 1161 can control a flow of fuel to an engine.

In an exemplary embodiment, first valve 1161 may be operated in a first position to allow fluid communication between auxiliary fuel tank 1130 and fuel rail 1102 of an engine. In particular, the first position of first valve 1161 provides fluid communication between first intake port 1171 and outtake port 1173 to allow fluid communication between a first fuel in auxiliary fuel tank 1130 and an engine. Furthermore, first valve 1161 prevents fluid communication between second intake port 1172 and outtake port 1173 in a first position. Using this arrangement, first valve 1161 may be operated in a first position to deliver a first fuel to an engine to allow a cold start of an engine.

When an engine does not require a cold start, first valve 1161 may be operated in a second position. In the second position, first valve 1161 may provide fluid communication between a mixed fuel in primary fuel tank 1103 and fuel rail 1102 of an engine, as illustrated in FIG. 11. In particular, the second position of first valve 1161 provides fluid communication between second intake port 1172 and outtake port 1173. In addition, the second position of first valve 1161 prevents fluid communication between first intake port 1171 and outtake port 1173. With this arrangement, a mixed fuel disposed in primary fuel tank 1103 can be delivered to fuel rail 1102 when first valve 1161 is in a second position.

In different embodiments, a mixed fuel may be delivered to auxiliary fuel tank 1130 in different manners, as previously discussed. In one embodiment, fuel system 1100 can include intake line 1185 to deliver a portion of mixed fuel from primary fuel tank 1103 to auxiliary fuel tank 1130. In some cases, intake line 1185 may be associated with a valve that controls an inflow of mixed fuel to auxiliary fuel tank 1130. For example, intake line 1185 may be associated with second valve 1162 that controls an inflow of mixed fuel to auxiliary fuel tank 1130.

As previously discussed, a fuel system may include provisions to control an inflow of mixed fuel from an intake line to an auxiliary fuel tank according to fuel level information. In one embodiment, fuel system 1100 includes sensor system 1190. Sensor system 1190 may be configured to detect fuel level information for auxiliary fuel tank 1130. In some cases, sensor system 1190 includes high level fuel sensor 1191 and low level fuel sensor 1192. High level fuel sensor 1191 can detect if auxiliary fuel tank 1130 is substantially full. Similarly, low level fuel sensor 1192 can detect if auxiliary fuel tank 1130 is substantially empty. With this configuration, sensor system 1190 can detect fuel level information of a first fuel in auxiliary fuel tank 1130.

In some embodiments, fuel system 1100 may be associated with electronic control unit 1120, hereby referred to as ECU 1120. Similar to a previous embodiment of ECU 120 illustrated in FIG. 1, ECU 1120 may include a number of ports that facilitate the input and output of information and power. All of the following ports and provisions associated with ECU 1120 are optional.

ECU 1120 can include first port 1131 configured to transfer information and/or power to sensor system 1190. With first port 1131, ECU 1120 can receive fuel level information associated with auxiliary fuel tank 1130. In addition, ECU 1120 can also include second port 1132 for transferring information and/or power to second valve 1162. This can allow ECU 1120 to control second valve 1162 and prevent or allow fluid communication between auxiliary fuel tank 1130 and primary fuel tank 1103. Using this configuration, ECU 112 may control second valve 1162 to achieve a desired fuel level.

In some embodiments, third port 1133 of ECU 1120 can be configured to transfer information regarding a current temperature of an engine. In one embodiment, third port 1133 of ECU 1120 can include provisions to transfer information and/or power to engine temperature sensor 1195. Engine temperature sensor 1195 may be configured in any manner known in the art to detect a current temperature of an engine. With third port 1133, ECU 1120 can receive information regarding the current temperature of an engine from engine temperature sensor 1195.

With information regarding the current temperature of an engine, ECU 1120 may be configured to control a first valve and deliver a first fuel to an engine in the event of a cold start of the engine. In particular, ECU 1120 can include fourth port 1134 configured to transfer information and/or power to first valve 1161. As previously discussed in embodiments illustrated in FIGS. 7 and 8, ECU 1120 can control the operation of first valve 1161 so that first valve 1161 is disposed in a first position to deliver a first fuel from auxiliary fuel tank 1130 to fuel rail 1102 during a cold start of an engine. Furthermore, ECU 1120 can operate first valve 1161 in a second position to deliver a mixed fuel from primary fuel tank 1103 to fuel rail 1102 when the engine is not in a cold start condition.

It should be understood that a fuel system with an auxiliary fuel tank and a primary fuel tank can be configured in various manners to deliver a mixed fuel from the primary fuel tank or a first fuel from the auxiliary fuel tank to an engine. For example, in embodiments where an auxiliary fuel tank is disposed within a primary fuel tank, various configurations of fuel pumps, fuel lines and valves may be used to deliver a mixed fuel from the primary fuel tank or a first fuel from the auxiliary fuel tank to the engine. FIGS. 12-16 illustrate schematic views of exemplary embodiments of various configurations of fuel system 1100 that can deliver a first fuel or a mixed fuel to an engine when the engine is in a cold start condition and a non-cold start condition, respectively.

In some embodiments, one or more fuel pumps may facilitate the delivery of a mixed fuel from the primary fuel tank and a first fuel from the auxiliary fuel tank to a fuel rail of an engine. In some cases, a primary fuel tank and an auxiliary fuel tank may be associated with different fuel pumps. Using this configuration, the fuel pumps can facilitate flow of a mixed fuel from a primary fuel tank and a first fuel from an auxiliary fuel tank.

Figure 12:
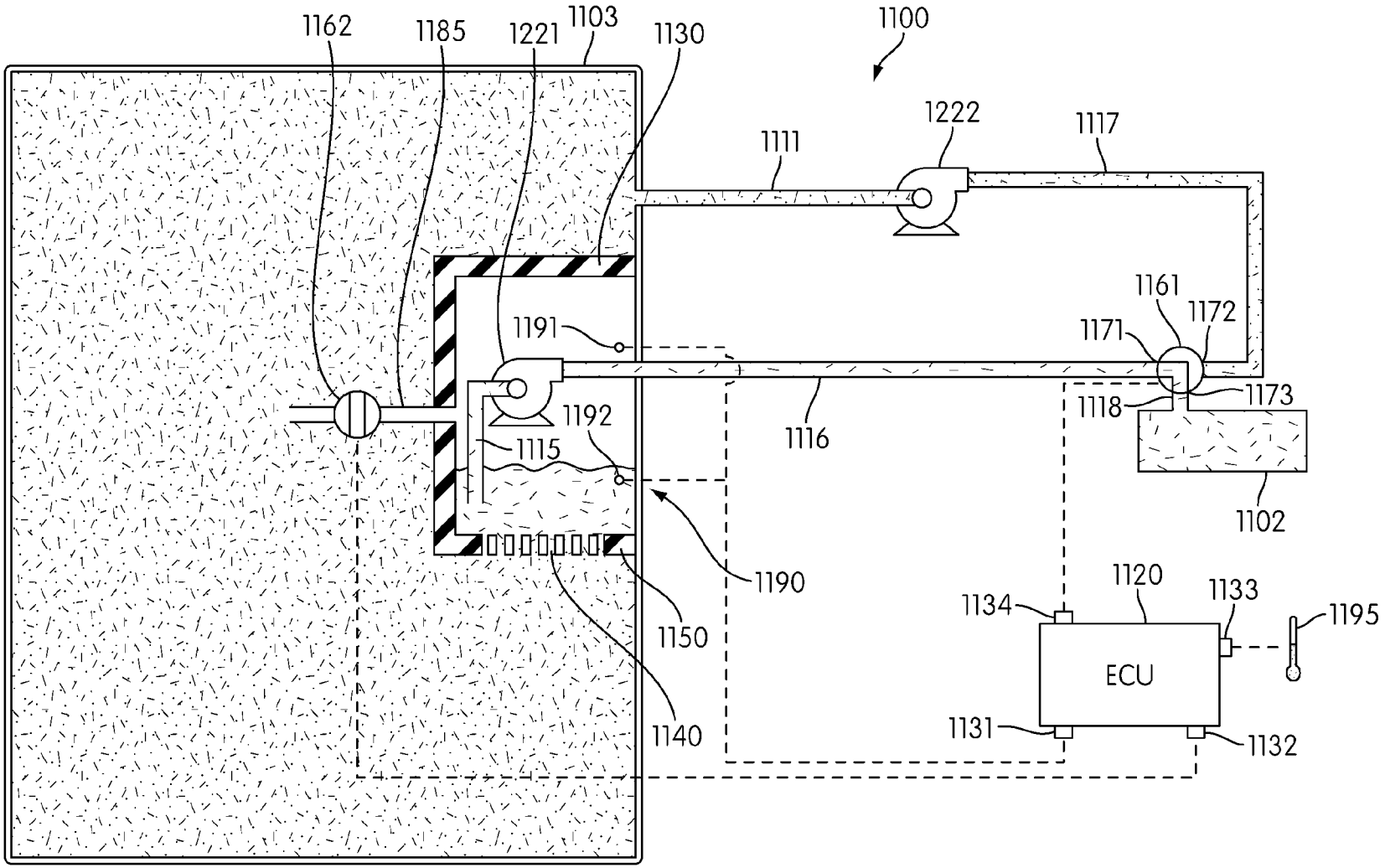
FIG. 12 is a schematic view of an exemplary embodiment of a portion of a fuel system with a fuel pump disposed within an auxiliary fuel tank.

Referring to FIG. 12, auxiliary fuel tank 1130 of fuel system 1100 may be associated with first fuel pump 1221. Similarly, primary fuel tank 1103 may be associated with second fuel pump 1222. In different embodiments, first fuel pump 1221 and second fuel pump 1222 may be located in different portions of fuel system 1100. For example, in some embodiments, first fuel pump 1221 may be disposed outside of auxiliary fuel tank 1130. In an exemplary embodiment, first fuel pump 1221 may be disposed within auxiliary fuel tank 1130.

In one embodiment, first fuel pump 1221 may be associated with fifth fuel line 1115 and sixth fuel line 1116. In particular, first fuel pump 1221 can facilitate the flow of fuel from fifth fuel line 1115 to sixth fuel line 1116. In some cases, fifth fuel line 1115 may be in fluid communication with auxiliary fuel tank 1130. With this arrangement, first fuel pump 1221 can facilitate flow of first fuel from fifth fuel line 1115 to sixth fuel line 1116.

In a similar manner, second fuel pump 1222 may be associated with first fuel line 1111 and seventh fuel line 1117. In some cases, first fuel line 1111 can be in fluid communication with a mixed fuel disposed in primary fuel tank 1103. With this arrangement, second fuel pump 1222 can assist in the delivery of mixed fuel from first fuel line 1111 to seventh fuel line 1117.

As previously discussed, first valve 1161 can control a flow of fuel to fuel rail 1102. In one embodiment, first valve 1161 may be in fluid communication with auxiliary fuel tank 1130 via sixth fuel line 1116 and fifth fuel line 1115. In particular, first intake port 1171 may be in fluid communication with sixth fuel line 1116. Likewise, second intake port 1172 of first valve 1161 can be in fluid communication with primary fuel tank 1103 via seventh fuel line 1117 and first fuel line 1111. In addition, first outtake port 1173 of first valve 1161 may be in fluid communication with fuel rail 1102 via eighth fuel line 1118. This configuration allows first valve 1161 to operate in a first position to deliver first fuel from auxiliary fuel tank 1130 to fuel rail 1102 or operate in a second position to deliver mixed fuel from primary fuel tank 1103 to fuel rail 1102.

In a manner similar to the previous embodiment, ECU 1120 may be configured to control the operation of first valve 1161 via fourth port 1134. With information regarding current temperature from engine temperature sensor 1195, ECU 1120 can operate first valve 1161 in a first position to deliver first fuel from auxiliary fuel tank 1130 to fuel rail 1102 during a cold start of an engine, as illustrated in FIG. 12. In some cases, first fuel pump 1221 can facilitate the flow of first fuel from auxiliary fuel tank 1130 when first valve 1161 is in a first position. When the engine is not in a cold start condition, ECU 1120 can operate first valve 1161 in a second position to deliver mixed fuel from primary fuel tank 1103 to fuel rail 1102. With this configuration, second fuel pump 1222 can facilitate the flow of mixed fuel from primary fuel tank 1103 to fuel rail 1102.

Figure 13:
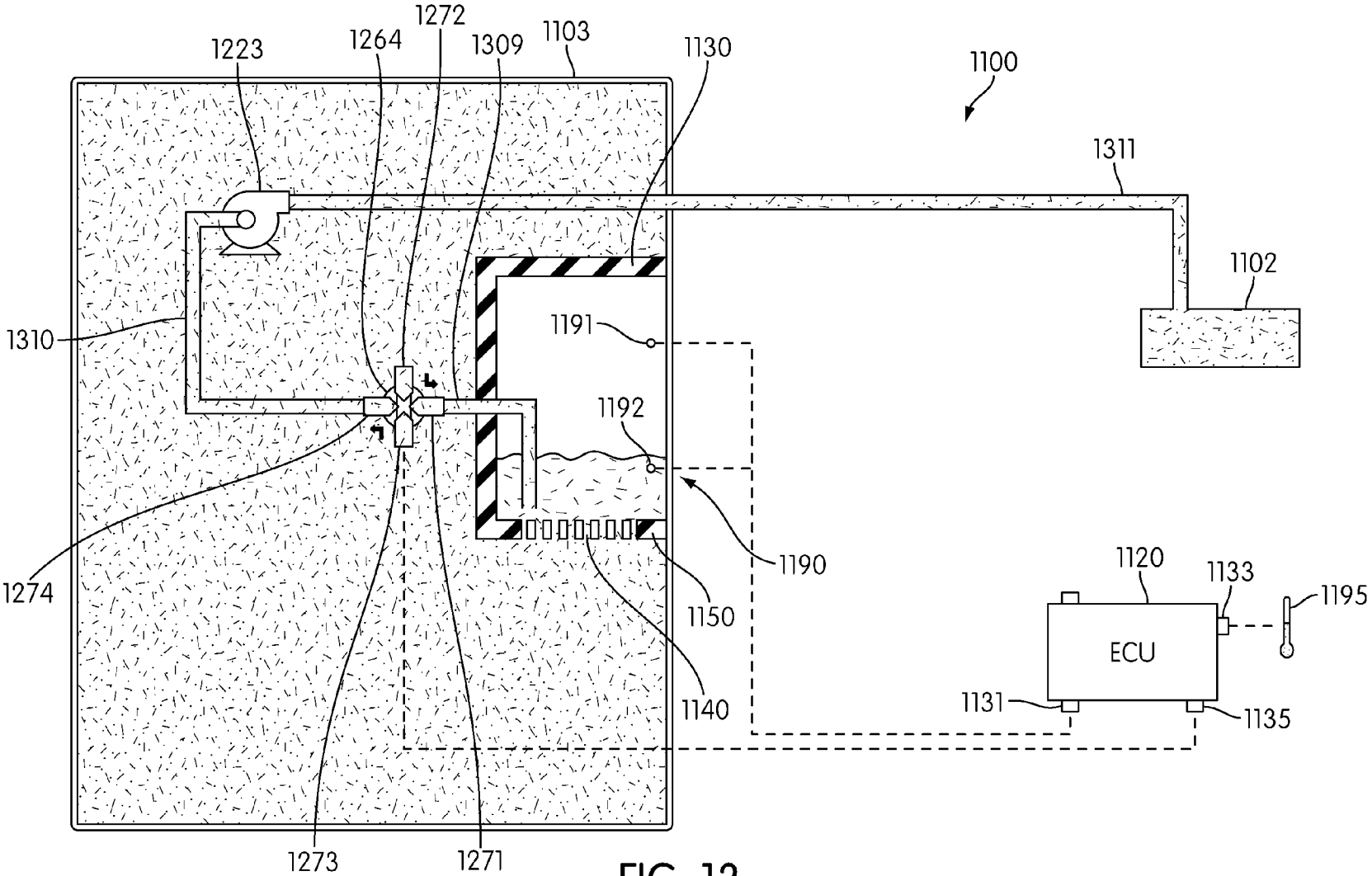
FIG. 13 is a schematic view of an exemplary embodiment of a portion of a fuel system with a four-way valve in a second position that can deliver mixed fuel from a primary fuel tank to a fuel rail and an auxiliary fuel tank.
Figure 14:
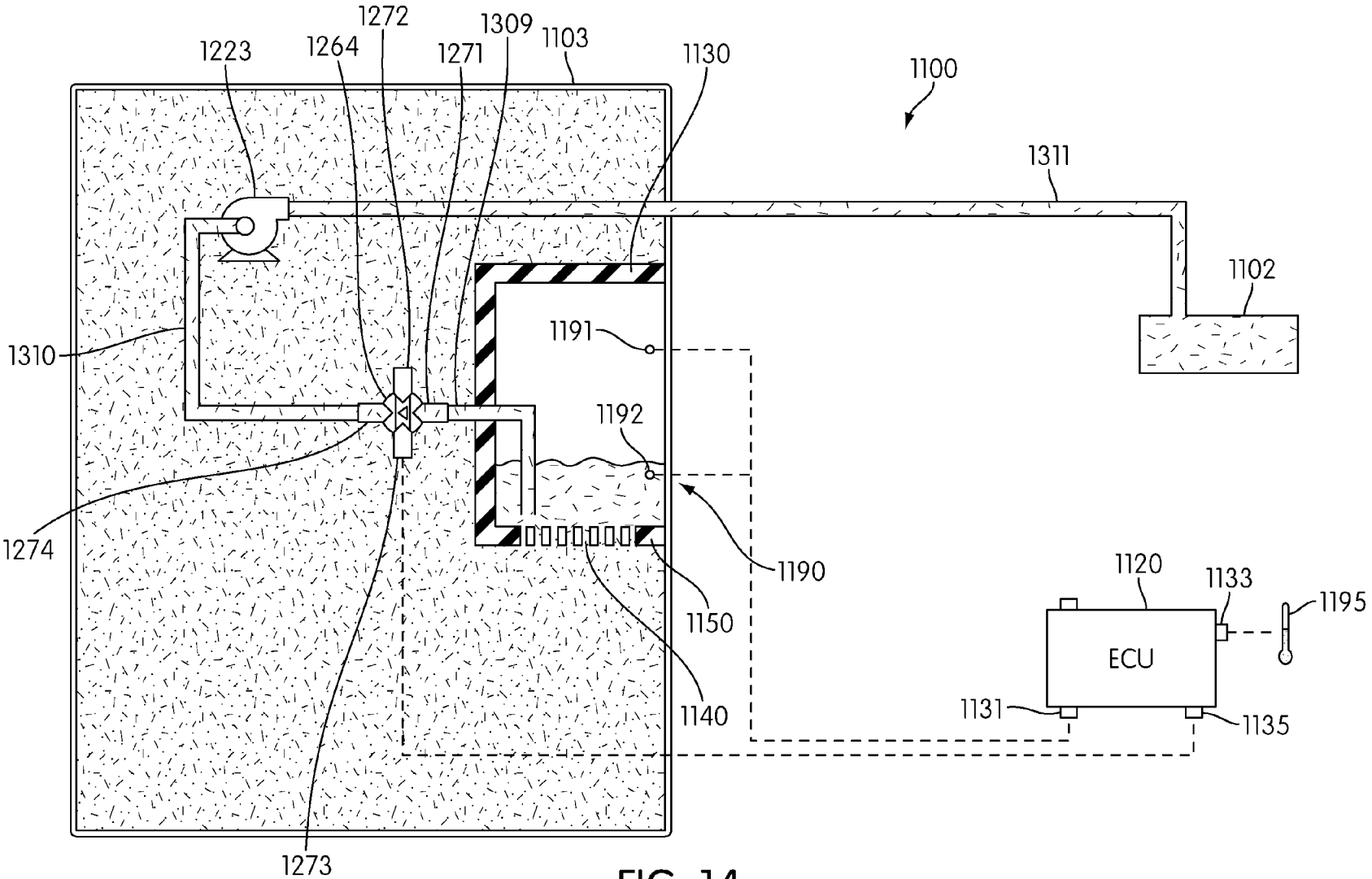
FIG. 14 is a schematic view of an exemplary embodiment of a portion of a fuel system with a four-way valve in a first position that can deliver first fuel from an auxiliary fuel tank to a fuel rail.

In some embodiments, a fuel system can include provisions to supply mixed fuel from a primary fuel tank to an engine and an auxiliary fuel tank when a valve is disposed in a second position. In some cases, a fuel system can include a four-way valve that can deliver first fuel to an engine in a first position and deliver mixed fuel from a primary fuel tank to an engine and an auxiliary fuel tank in a second position. Referring to FIGS. 13 and 14, fuel system 1100 includes four-way valve 1264 that is configured to allow mixed fuel from primary fuel tank 1103 to flow to fuel rail 1102 and auxiliary fuel tank 1130 in a second position.

In different embodiments, four-way valve 1264 may be disposed in different portions of fuel system 1100. In some embodiments, four-way valve 1264 may be disposed outside of primary fuel tank 1103. In an exemplary embodiment, four-way valve 1264 may be disposed within primary fuel tank 1103.

In order to communicate fuel through four-way valve 1264, four-way valve 1264 may include ports. In some embodiments, a port of four-way valve 1264 may act as both an intake port and an outtake port. In some cases, a port may allow an inflow of fuel when four-way valve 1264 is in a first position and an outflow of fuel when four-way valve 1264 is in a second position. In one embodiment, four-way valve 1264 includes first port 1271 that allows an inflow or an outflow of fuel when four-way valve 1264 is in a first or second position, respectively.

In some embodiments, first port 1271 may be in fluid communication with auxiliary fuel tank 1130 via ninth fuel line 1309. Four-way valve 1264 may also be in fluid communication with primary fuel tank 1103. In some cases, first intake port 1272 and second intake port 1273 of four-way valve 1264 may be in fluid communication with primary fuel tank 1103. In addition, first outtake port 1274 of four-way valve 1264 may be in fluid communication with fuel rail 1102 via tenth fuel line 1310 and eleventh fuel line 1311.

In some embodiments, fuel system 1100 may include a fuel pump to facilitate the flow of fuel. As previously discussed, a fuel pump may be disposed in different locations of fuel system 1100 to facilitate the flow of fuel within fuel lines. In one embodiment, third fuel pump 1223 may be disposed within primary fuel tank 1103. In particular, third fuel pump 1223 may facilitate the flow of either mixed fuel or a first fuel from tenth fuel line 1310 to eleventh fuel line 1311. Eleventh fuel line 1311 may be in fluid communication with fuel rail 1102. This arrangement allows third fuel pump 1223 to facilitate the flow of either mixed fuel or a first fuel to fuel rail 1102.

Referring to FIG. 13, four-way valve 1264 is in a second position configured to deliver mixed fuel to fuel rail 1102. In one embodiment, second intake port 1273 and first outtake port 1274 may be in fluid communication when four-way valve 1264 is in a second position. In some cases, third fuel pump 1223 can facilitate flow of mixed fuel from primary fuel tank 1103 to fuel rail 1102 via tenth fuel line 1310 and eleventh fuel line 1311 when four-way valve 1264 is in a second position.

In a second position, four-way valve 1264 may also deliver a mixed fuel from primary fuel tank 1103 to auxiliary fuel tank 1130. In particular, first intake port 1272 may be in fluid communication with first port 1271 when four-way valve 1264 is in the second position. In some cases, the force of gravity can assist in the flow of a mixed fuel through first intake port 1272 to first port 1271. With this configuration, a mixed fuel can be delivered from primary fuel tank 1103 to auxiliary fuel tank 1130 via ninth fuel line 1309 when four-way valve 1264 operates in a second position. By delivering a mixed fuel to auxiliary fuel tank 1130 and fuel rail 1102 when four-way valve 1264 is in a second position, the configuration and operation of fuel system 1100 may be simplified.

Four-way valve 1264 may also provide fluid communication between auxiliary fuel tank 1130 and fuel rail 1102. For example, referring to FIG. 14, four-way valve 1264 can allow fluid communication between first port 1271 and first outtake port 1274 when disposed in a first position. In some cases, third fuel pump 1223 may facilitate the flow of first fuel from auxiliary fuel tank 1130 to fuel rail 1102 through ninth fuel line 1309, four-way valve 1264, tenth fuel line 1310 and eleventh fuel line 1311. With this configuration, four-way valve 1264 may provide fluid communication of first fuel to fuel rail 1102 in a first position.

In some embodiments, ECU 1120 can include provisions for transferring information and/or power with four-way valve 1264. Referring to FIGS. 13 and 14, ECU 1120 can include fifth port 1135 configured to transfer information and/or power to four-way valve 1264. As previously discussed, ECU 1120 may receive information regarding the current temperature of an engine from engine temperature sensor 1195 via third port 1133. With this configuration, ECU 1120 can operate four-way valve 1264 in a first position to deliver first fuel from auxiliary fuel tank 1130 to fuel rail 1102 during a cold start of an engine. Similarly, ECU 1120 may operate four-way valve 1264 in a second position during non-cold start conditions.

In addition, ECU 1120 also receives information regarding fuel level of auxiliary fuel tank 1130 from sensor system 1190 via first port 1131. In some cases, ECU 1120 may operate four-way valve 1264 in a second position when sensor system 1190 detects that auxiliary fuel tank 1130 is substantially empty. With this arrangement, auxiliary fuel tank 1130 can be filled from primary fuel tank 1103 via four-way valve 1264.

Figure 15:
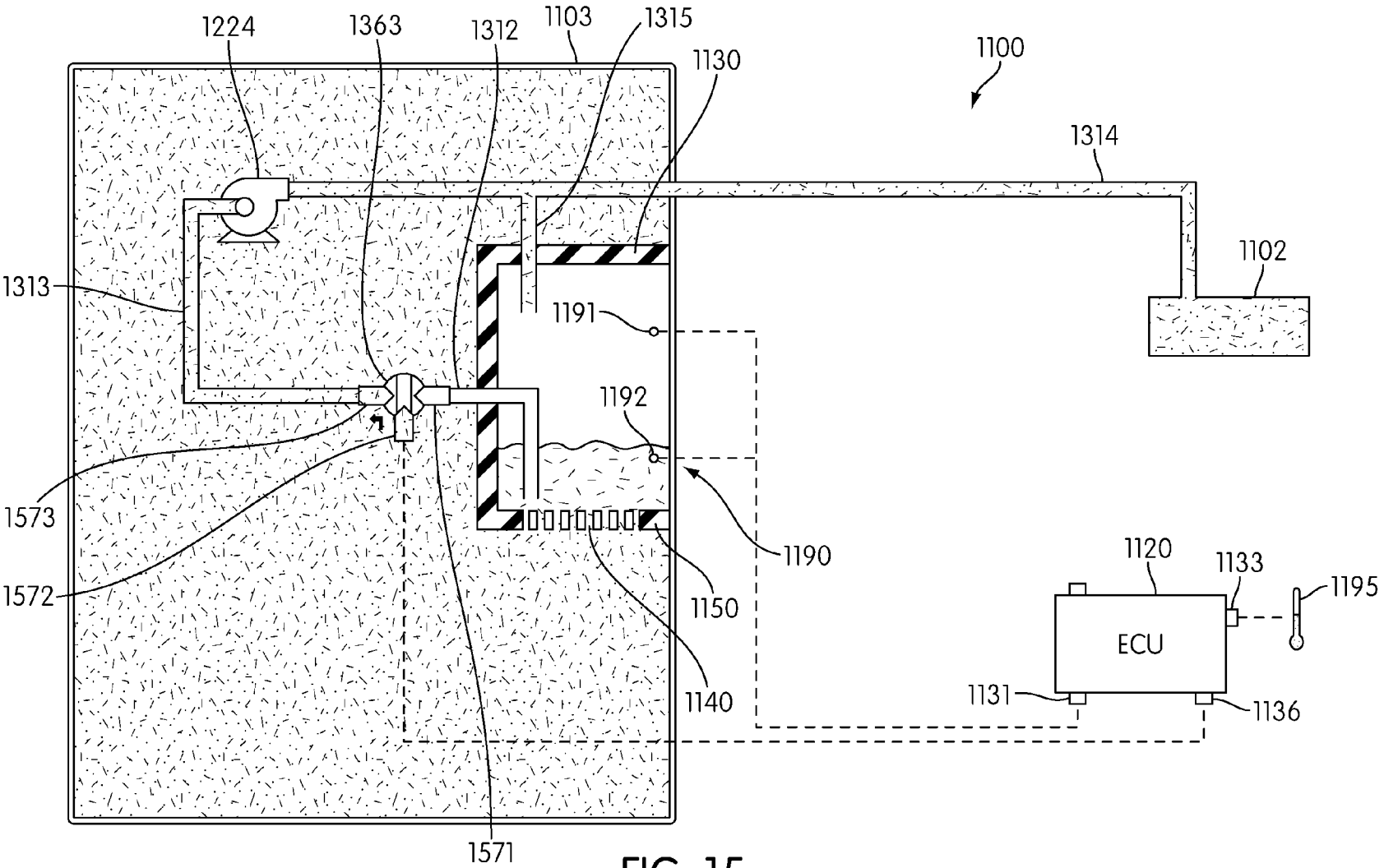
FIG. 15 is a schematic view of an exemplary embodiment of a portion of a fuel system with a three-way valve that can deliver a mixed fuel or a first fuel to a fuel rail.

Referring to FIG. 15, fuel system 1100 includes three-way valve 1363. Generally, three-way valve 1363 can be any type of valve. In one embodiment, three-way valve 1363 can include first intake port 1571, second intake port 1572 and first outtake port 1573. First intake port 1571 may be in fluid communication with auxiliary fuel tank 1130 via twelfth fuel line 1312. Likewise, second intake port 1572 may be in fluid communication with primary fuel tank 1103. Also, first outtake port 1573 may be in fluid communication with fuel rail 1102 via thirteenth fuel line 1313 and fourteenth fuel line 1314. Furthermore, first outtake port 1573 may also be in fluid communication with auxiliary fuel tank 1130 via thirteenth fuel line 1313, fourteenth fuel line 1314 and fifteenth fuel line 1315.

A fuel system can include provisions to deliver pressurized mixed fuel from a primary fuel tank to an auxiliary fuel tank and an engine. In some cases, a fuel system can deliver pressurized mixed fuel to an auxiliary fuel tank and a fuel rail when a valve is disposed in a second position. By providing pressurized mixed fuel to the auxiliary fuel tank, the efficiency of a separating device separating the mixed fuel into a first fuel and a second fuel can be increased.

In some embodiments, fuel system 1100 can include fourth fuel pump 1224. Fourth fuel pump 1224 may be associated with thirteenth fuel line 1313 and fourteenth fuel line 1314. As previously discussed, thirteenth fuel line 1313 may be associated with first outtake port 1573 of three-way valve 1363. In a similar manner, fourteenth fuel line 1314 may be associated with fuel rail 1102. In addition, fourteenth fuel line 1314 may also be associated with fifteenth fuel line 1315. Fifteenth fuel line 1315 may be in fluid communication with auxiliary fuel tank 1130. This arrangement allows fourth fuel pump 1224 to facilitate the flow of fuel from first outtake port 1573 of three-way valve 1363 to fuel rail 1102 and auxiliary fuel tank 1130. Using this configuration, fourth fuel pump 1224 can facilitate the delivery of pressurized fuel to auxiliary fuel tank 1130 to increase the efficiency of separating device 1140.

In a first and second position, three-way valve 1363 can provide fluid communication between different intake ports and first outtake port 1274. For example, in a first position, three-way valve 1363 can provide fluid communication between first intake port 1571 and first outtake port 1573. This allows fluid communication of a first fuel from auxiliary fuel tank 1130 to fuel rail 1102. In some cases, fourth fuel pump 1224 can facilitate the flow of a first fuel to fuel rail 1102 when three-way valve 1363 is in a first position. Similarly, three-way valve 1363 can be operated in a second position to allow fluid communication between second intake port 1572 and first outtake port 1573. This configuration allows fluid communication of mixed fuel from primary fuel tank 1103 to fuel rail 1102 and auxiliary fuel tank 1130. In particular, fourth fuel pump 1224 may facilitate the flow of pressurized mixed fuel to auxiliary fuel tank 1130 and fuel rail 1102 when three-way valve 1363 is in a second position, as illustrated in FIG. 15.

In some embodiments, ECU 1120 can include sixth port 1136 that is configured to transfer information and/or power to three-way valve 1363. In particular, ECU 1120 can control the operation of three-way valve 1363 so that three-way valve 1363 is in a first position to deliver a first fuel from auxiliary fuel tank 1130 to fuel rail 1102 in the event of a cold start of an engine. In a similar manner, ECU 1120 can operate three-way valve 1363 in a second position to deliver a mixed fuel from primary fuel tank 1103 to fuel rail 1102 when the engine is in a non-cold start condition. In some cases, ECU 1120 may operate three-way valve 1363 in the second position when sensor system 1190 indicates that auxiliary fuel tank 1130 is substantially empty.

Figure 16:
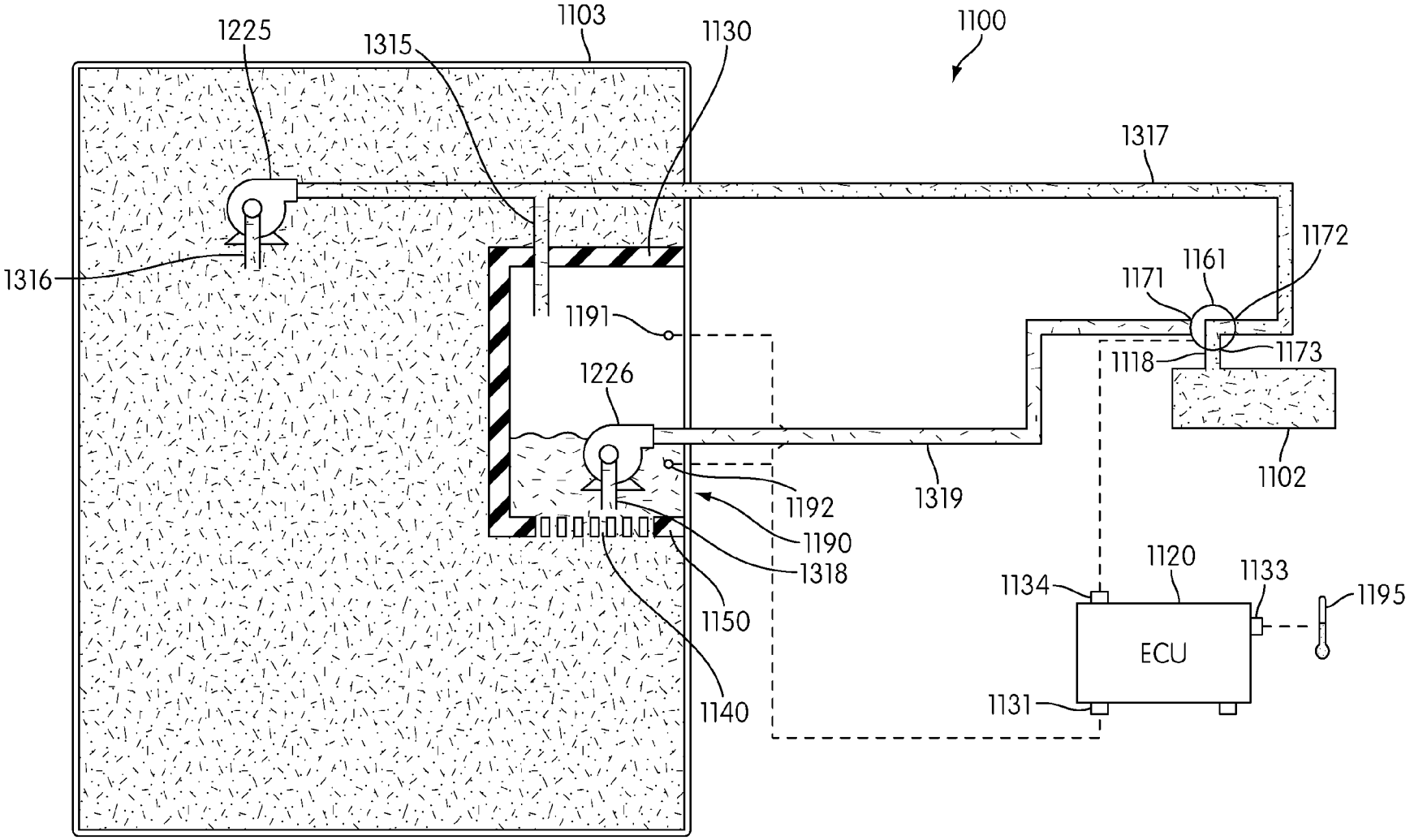
FIG. 16 is a schematic view of an exemplary embodiment of a portion of a fuel system.

In embodiments where a first fuel pump facilitates the delivery of pressurized mixed fuel to a fuel rail and an auxiliary fuel tank, the fuel system may also be configured with a second fuel pump that facilitates the flow of a first fuel to a fuel rail. For example, fuel system 1100 includes fifth fuel pump 1225 that can facilitate the delivery of pressurized mixed fuel to fuel rail 1102 and auxiliary fuel tank 1130, as illustrated in FIG. 16. In some embodiments, fuel system 1100 can also include sixth fuel pump 1226 that can facilitate the flow of a first fuel to fuel rail 1102.

In one embodiment, fifth fuel pump 1225 may be associated with sixteenth fuel line 1316 and seventeenth fuel line 1317. Sixteenth fuel line 1316 may be in fluid communication with mixed fuel disposed in primary fuel tank 1103. In addition, seventeenth fuel line 1317 may be in fluid communication with first valve 1161 that controls the flow of fuel to fuel rail 1102. In some cases, seventeenth fuel line 1317 may also be associated with fifteenth fuel line 1315. Fifteenth fuel line 1315 can be in fluid communication with auxiliary fuel tank 1130. This configuration allows fifth fuel pump 1225 to facilitate the flow of mixed fuel to fuel rail 1102 as well as auxiliary fuel tank 1130. By facilitating the delivery of pressurized mixed fuel to auxiliary fuel tank 1130, fifth fuel pump 1225 can increase the efficiency of separating device 1140.

Furthermore, sixth fuel pump 1226 may be associated with eighteenth fuel line 1318 and nineteenth fuel line 1319. Eighteenth fuel line 1318 may be in fluid communication with auxiliary fuel tank 1130. Nineteenth fuel line 1319 may be in fluid communication with first valve 1161 that controls the flow of fuel to fuel rail 1102. With this arrangement, sixth fuel pump 1226 can facilitate the flow of a first fuel from auxiliary fuel tank 1130 to fuel rail 1102.

As previously discussed, ECU 1102 may operate first valve 1161 in a first position to deliver a first fuel to an engine to allow a cold start of an engine. In an exemplary embodiment, sixth fuel pump 1226 can facilitate the flow of a first fuel to fuel rail 1102 when first valve 1161 is in a first position. Furthermore, ECU 1120 can operate first valve 1161 in a second position to provide fluid communication between a mixed fuel in primary fuel tank 1103 and fuel rail 1102 during non-cold start conditions, as illustrated in FIG. 16. In some cases, fifth fuel pump 1225 can facilitate the flow of a mixed fuel from primary fuel tank 1103 to fuel rail 1102 when first valve 1161 is in a second position.

In some embodiments, ECU 1120 may be configured to receive fuel level information of auxiliary fuel tank 1130 via sensor system 1190. In embodiments of fuel system 1100 that do not include a valve disposed between fifth fuel pump 1225 and fifteenth fuel line 1315, fifth fuel pump 1225 can deliver pressurized mixed fuel to auxiliary fuel tank 1130 in a substantially continuous manner. In other cases, however, ECU 1120 can be configured to control fifth fuel pump 1225 in order to deliver pressurized mixed fuel to auxiliary fuel tank 1130 when sensor system 1190 indicates that auxiliary fuel tank 1130 is substantially empty.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An auxiliary fuel tank for a motor vehicle, comprising:

a tank body;

an intake line configured to deliver a mixed fuel to the tank body;

a separating device disposed within the tank body and configured to separate the mixed fuel into a first fuel and a second fuel;

a first compartment formed within the tank body and configured to store the first fuel;

a second compartment formed within the tank body and configured to store the second fuel, the first compartment sharing at least one wall with the second compartment and the separating device being disposed between the first compartment and the second compartment such that the separating device divides the tank body into the first compartment and the second compartment;

a first fuel path configured to deliver the first fuel directly from the first compartment to an engine of the motor vehicle during a cold start;

a sensor system configured to detect fuel level information of the first fuel in the first compartment;

a first valve configured to control the inflow of the mixed fuel from the intake line; and wherein the first valve is controlled according to the fuel level information.

2. The auxiliary fuel tank according to claim 1, wherein the first fuel path comprises a first fuel line and a second fuel line.

3. The auxiliary fuel tank according to claim 2, further comprising a second valve connecting the first fuel line to the second fuel line and the second fuel line to a third fuel line extending from a primary fuel tank, the second valve configured to control outflow of the first fuel from the first compartment of the auxiliary fuel tank to the engine and outflow of the mixed fuel from the primary fuel tank to the engine.

4. The auxiliary fuel tank according to claim 3, wherein the second valve has a first position in which the first fuel is allowed to flow from the first compartment to the engine and the mixed fuel is blocked from flowing from the primary fuel tank to the engine and the second valve has a second position in which the mixed fuel is allowed to flow from the primary fuel tank to the engine and the first fuel is blocked from flowing from the first compartment to the engine.

5. The auxiliary fuel tank according to claim 1, wherein the sensor system comprises a low level sensor associated with a low level of the first fuel in the first compartment and wherein the sensor system comprises a high level sensor associated with a high level of the first fuel in the first compartment.

6. The auxiliary fuel tank according to claim 5, wherein the first valve is controlled to allow mixed fuel to enter the first compartment from the primary fuel tank when the low level sensor is triggered and wherein the first valve is controlled to prevent mixed fuel from entering the first compartment from the primary fuel tank when the high level sensor is triggered.

7. A cold start system for a motor vehicle, comprising:

a primary fuel tank configured to store a mixed fuel and an auxiliary fuel tank configured to receive a portion of the mixed fuel from the primary fuel tank;

a separating device disposed within the auxiliary fuel tank for separating the mixed fuel into a first fuel and a second fuel;

the auxiliary fuel tank including a first compartment formed within the auxiliary fuel tank and configured to store the first fuel;

the auxiliary fuel tank including a second compartment formed within the auxiliary fuel tank and configured to store the second fuel, the first compartment sharing at least one wall with the second compartment and the separating device being disposed between the first compartment and the second compartment such that the separating device divides the auxiliary fuel tank into the first compartment and the second compartment;

the primary fuel tank and the auxiliary fuel tank being further connected to a valve that controls flow to an engine of the motor vehicle;

the valve including a first position wherein the first compartment is in fluid communication with the engine and wherein the primary fuel tank is blocked from fluid communication with the engine;

the valve including a second position wherein the primary fuel tank is in fluid communication with the engine and wherein the first compartment is blocked from fluid communication with the engine; and wherein the valve is disposed in the first position whenever the engine temperature is below a predetermined temperature and wherein the valve is disposed in a second position whenever the engine temperature is above the predetermined temperature.

8. The cold start system according to claim 7, wherein the auxiliary fuel tank has a fuel path configured to deliver the first fuel directly from the first compartment to the engine.

9. The cold start system according to claim 7, wherein the separating device permits one-way fluid communication of the second fuel from the first compartment to the second compartment.

10. The cold start system according to claim 8, wherein a return line is connected to the second compartment and the primary fuel tank, wherein the return line provides fluid communication between the second compartment and the primary fuel tank, and wherein the valve is configured to block and unblock the fuel path between the auxiliary fuel tank and the engine.

11. The cold start system according to claim 10, wherein the second fuel from the second compartment is returned to the primary fuel tank using the return line.

12. The cold start system according to claim 10, wherein the fuel path includes a first fuel line and a second fuel line, the valve connecting the first fuel line to and through the second fuel line.

13. The cold start system according to claim 7, wherein the first position is associated with a cold start condition of the engine and the second position is associated with a non-cold start condition of the engine.

14. The cold start system according to claim 10, wherein a third fuel line is connected to the primary fuel tank and the valve such that fluid flows from the primary fuel tank to the second fuel line when the valve is in the second position.

15. A method of operating a cold start system for a motor vehicle, comprising the steps of:

delivering a portion of a mixed fuel from a primary fuel tank to an auxiliary fuel tank having a chamber divided into a first compartment and a second compartment by a membrane;

wherein the first compartment of the auxiliary fuel tank shares at least one wall with the second compartment of the auxiliary fuel tank; using the membrane to separate the mixed fuel into a first fuel disposed in the first compartment of the auxiliary fuel tank and a second fuel disposed in the second compartment of the auxiliary fuel tank;

receiving information related to a current engine temperature;

comparing the current engine temperature with a predetermined engine temperature;

placing the first compartment of the auxiliary fuel tank in fluid communication with an engine and blocking fluid communication between the primary fuel tank and the engine whenever the current engine temperature is less than the predetermined engine temperature; and placing the primary fuel tank in fluid communication with the engine and blocking fluid communication between the auxiliary fuel tank and the engine whenever the current engine temperature is above the predetermined engine temperature.

16. The method according to claim 15, wherein the step of placing the first compartment of the auxiliary fuel tank in fluid communication with the engine includes delivering the first fuel directly from the first compartment of the auxiliary fuel tank to the engine.

17. The method according to claim 16, wherein the step of placing the first compartment of the auxiliary fuel tank in fluid communication with the engine includes moving a valve to a first position from a second position.

18. The method according to claim 15, wherein the step of receiving information related to a current engine temperature includes a step of receiving information related to a current fuel level of the auxiliary fuel tank.

19. The method according to claim 18, wherein the step of receiving information related to the current fuel level is followed by a step of placing the auxiliary fuel tank in fluid communication with the primary fuel tank and thereby allowing mixed fuel to flow from the primary fuel tank to the auxiliary fuel tank whenever the current fuel level is low.

20. The method according to claim 17, wherein the step of placing the primary fuel tank in fluid communication with the engine includes moving the valve from the first position to the second position.

21. A cold start system for a motor vehicle, comprising:

a primary fuel tank configured to store a mixed fuel and an auxiliary fuel tank disposed within the primary fuel tank, the auxiliary fuel tank configured to receive a portion of the mixed fuel from the primary fuel tank;

a membrane for separating the mixed fuel into a first fuel and a second fuel, the membrane being disposed between the auxiliary fuel tank and the primary fuel tank such that the membrane forms a boundary between the auxiliary fuel tank and the primary fuel tank;

the membrane allowing the second fuel to pass from the auxiliary fuel tank to the primary fuel tank and the membrane preventing the mixed fuel from passing from the primary fuel tank to the auxiliary fuel tank;

a first fuel path configured to deliver the first fuel directly from the auxiliary fuel tank to an engine; and wherein the primary fuel tank is in fluid communication with the engine when the engine temperature is above a predetermined engine temperature and wherein the auxiliary fuel tank is in fluid communication with the engine when the engine temperature is below a predetermined engine temperature.

* * * * *